US007476121B2

(12) United States Patent
Tsuji

(10) Patent No.: US 7,476,121 B2
(45) Date of Patent: Jan. 13, 2009

(54) CONNECTOR COVER

(75) Inventor: Takeshi Tsuji, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/117,809

(22) Filed: May 9, 2008

(65) Prior Publication Data

US 2008/0280467 A1 Nov. 13, 2008

(30) Foreign Application Priority Data

May 9, 2007 (JP) ..... 2007-124865

(51) Int. Cl.
*H01R 13/58* (2006.01)

(52) U.S. Cl. ..... 439/471; 439/906; 439/465

(58) Field of Classification Search ..... 439/449, 439/464, 465, 470, 471, 906
See application file for complete search history.

(56) References Cited

U.S. PATENT DOCUMENTS 4,900,277 A * 2/1990 Inaba et al. ..... 439/752
6,019,645 A * 2/2000 Avery et al. ..... 439/752
7,201,592 B2 4/2007 Hata

* cited by examiner

*Primary Examiner*—Khiem Nguyen
(74) *Attorney, Agent, or Firm*—Gerald E. Hespos; Anthony J. Casella

(57) ABSTRACT

A connector cover (14) holds a corrugated tube (15) surrounding wires (W) drawn out from the rear side of a housing (12) and is mounted on the rear side of the housing (12). The cover (14) has first and second cover shells (29, 30) to be assembled with each other. The cover shells (29, 30) include tube holders (28) capable of holding an end portion of the corrugated tube (15) therebetween. The first cover shell (29) includes locks (49), and the second cover shell (30) includes lock pieces (50) engageable with the locks (49). The first cover shell (29) has lock-piece protecting portions (54) to be arranged adjacent to leading end corners (53) of the lock pieces (50) corresponding to the tube holder (28) and projecting more outward than the lock pieces (50) in the thickness directions thereof.

14 Claims, 27 Drawing Sheets

CONNECTOR COVER

BACKGROUND OF THE INVENTION

1. Field of the Invention

The invention relates to a connector cover.

2. Description of the Related Art

Many connectors are mounted at an end of an automotive wiring harness, and some of these connectors are provided with a connector cover for holding a corrugate tube for protecting wires. An example of such a connector is disclosed in U.S. Pat. No. 7,201,592. This connector is provided with a housing for accommodating terminal fittings connected with ends of wires, a corrugated tube for protecting the wires drawn out from the rear side of the housing by surrounding them, and a connector cover adapted to hold an end portion of the corrugated tube and mountable on the rear side of the housing. The connector cover is comprised of a pair of cover shells to be assembled with each other, and each of the both cover shells includes a tube holding portion for holding the corrugated tube and a housing mounting portion to be mounted on the housing. Each of the cover shells includes lock pieces and locks, and the two cover shells can be held assembled by the engagement of the lock pieces and the locks.

Since the connector with the above construction is provided at an end of a wiring harness, it is often roughly handled at the time of transportation to an automotive assembly line or assembling into an automotive vehicle. At that time, members such as wires and external matter may interfere with the connector. If the lock piece of the connector gets caught by the wire or the like, there has been a possibility that the lock piece is resiliently deformed in an unlocking direction to separate the two cover shells.

Particularly, there has been a problem that the two cover shells are likely to be separated if the lock piece near the tube holding portion holding the corrugated tube gets caught by a wire or the like, the frequent action of external forces on the corrugated tube being a contributing negative factor.

The invention was developed in view of the above and an object thereof is to prevent two cover shells from being separated inadvertently.

SUMMARY OF THE INVENTION

The invention relates to a connector cover mountable on the connector housing and adapted to hold at least one wire protecting tube surrounding one or more wires drawn out from the housing. The connector cover includes at least first and second cover shells to be assembled together. The cover shells include tube holders for holding a portion of the wire protecting tube therebetween. The first cover shell includes one or more locks. The second cover shell includes one or more lock pieces engageable with the respective locks to hold the cover shells in an assembled state. The first cover shell further includes at least one lock-piece protector to be arranged adjacent to at least one leading corner of the lock piece corresponding to the tube holder and/or projecting more out than the lock piece in the thickness direction thereof.

The cover shells are held in the assembled state by the engagement of the lock pieces with the locks. At this time, the wire protecting tube surrounding the wires drawn out from the rear surface of the housing is held by the tube holder. The lock-piece protector projects out beyond the lock piece in the thickness direction thereof and is adjacent the leading corner of the lock piece corresponding to the tube holder in this assembled state. Thus, wires and other external matter are not likely to interfere with the lock piece. Therefore, the locked state is unlikely to be canceled inadvertently even if an external force acts on the wire protecting tube.

The lock-piece protector preferably is present at a position substantially diagonally opposite to the leading end corner of the lock piece. With such an arrangement, the interference of the wires and the like with the leading end corner of the lock piece can be prevented effectively.

The lock-piece protector preferably is curved, bent, angled or L-shaped to surround the leading end corner of the lock piece. With such a shape, the interference of the wires and the like with the leading end corners of the lock piece can be prevented reliably and a highly significant effect of preventing the separation of the cover-divided parts can be obtained.

At least one pair of lock-piece protectors preferably are arranged substantially in correspondence with opposite leading end corners of the lock piece while being spaced apart from each other to define a disengagement space used to disengage the lock piece. With such an arrangement, interference of the wires and the like with the opposite leading end corners of the lock piece can be prevented effectively and an operation of disengaging the lock piece can be facilitated.

Overlapping walls are provided at or near division end portions of the both cover shells and can be placed one inside the other in the assembled state. The overlapping wall of the second cover shell preferably is arranged outside that of the first cover shell. The lock pieces extend substantially in an assembling direction from the overlapping wall of the second cover shell. With such an arrangement, an assembling operation can be performed more easily since both cover shells are positioned by placing the overlapping walls one inside the other upon assembling the cover shells. Further, the lock pieces extend in the assembling direction from the overlapping wall, and the springiness or resiliency of the lock pieces can be ensured.

The first cover shell preferably has at least one overlapping-wall protecting portion that substantially faces the leading end of the overlapping wall of the second cover shell at an adjacent position. Thus the wires and the like cannot interfere with the overlapping wall arranged at the outer side. Therefore the separation of the two cover shells can be prevented. Further, the entrance of external matter into a clearance between the overlapping walls can be made more difficult by the overlapping-wall protector.

The overlapping-wall protector projects out beyond the overlapping wall of the second cover shell in the thickness directions thereof. Thus, the overlapping wall arranged at the outer side is less likely to get caught by the wires and the like.

The lock-piece protector preferably is connected with the overlapping-wall protector. With such an arrangement, the overlapping-wall protector and the lock-piece preventor constitute a continuous wall and the lock piece and the overlapping wall arranged at the outer side can be protected at once. Thus, the lock piece and overlapping wall cannot get caught by the wires and the like.

The overlapping-wall protector and the lock-piece protector may have the same projecting distance. Such an arrangement can improve the external appearance and contribute to miniaturization.

The overlapping-wall protector may be formed with at least one reverse tapered surface for at least partly covering the leading end of the overlapping wall of the second cover-divided part from an outer side. With such a construction, the inadvertent disengagement of the lock piece can be prevented more reliably since an outward deformation of the overlapping wall connected with the lock piece is prevented by the reverse tapered surface.

Two reverse tapered surfaces preferably are formed at positions of the overlapping-wall protector at substantially opposite sides of the lock piece. With such a construction, inadvertent disengagement of the lock piece can be prevented even more reliably.

The locks preferably are at a plurality of spaced apart positions and are engageable with the corresponding lock pieces substantially at once. Thus, at least one of the locks is highly likely to remain engaged even if an external force should act on one of the leading end corners of the lock piece in an unlocking direction.

The lock piece preferably includes a reinforcement insertable between adjacent locks. Thus, the lock piece is stronger, more springy and less likely to be damaged.

The lock pieces and the locks preferably are at plural positions near the division ends of the cover shells, and the lock-piece protector is provided in correspondence with each lock piece. With such an arrangement, the separation of the two cover shells is even more difficult.

A clearance between the lock-piece protector and the lock piece preferably is substantially equal to or smaller than the outer diameter of the wires. Thus, the wires are not likely to enter into the clearance between the lock-piece preventor and the lock piece.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A watertight connector in accordance with a first embodiment of the invention is described with reference to FIGS. 1 to 23 and is identified generally by the numeral 10. In the following description, reference is made to FIGS. 2 and 5 concerning the vertical direction (longitudinal direction) and to FIGS. 1, 6 and 8 concerning left and right sides. A connection side (lower side in FIG. 1) with a mating connector and an opposite side (upper side in FIG. 1) are referred to respectively as front and rear ends.

Figure 1:
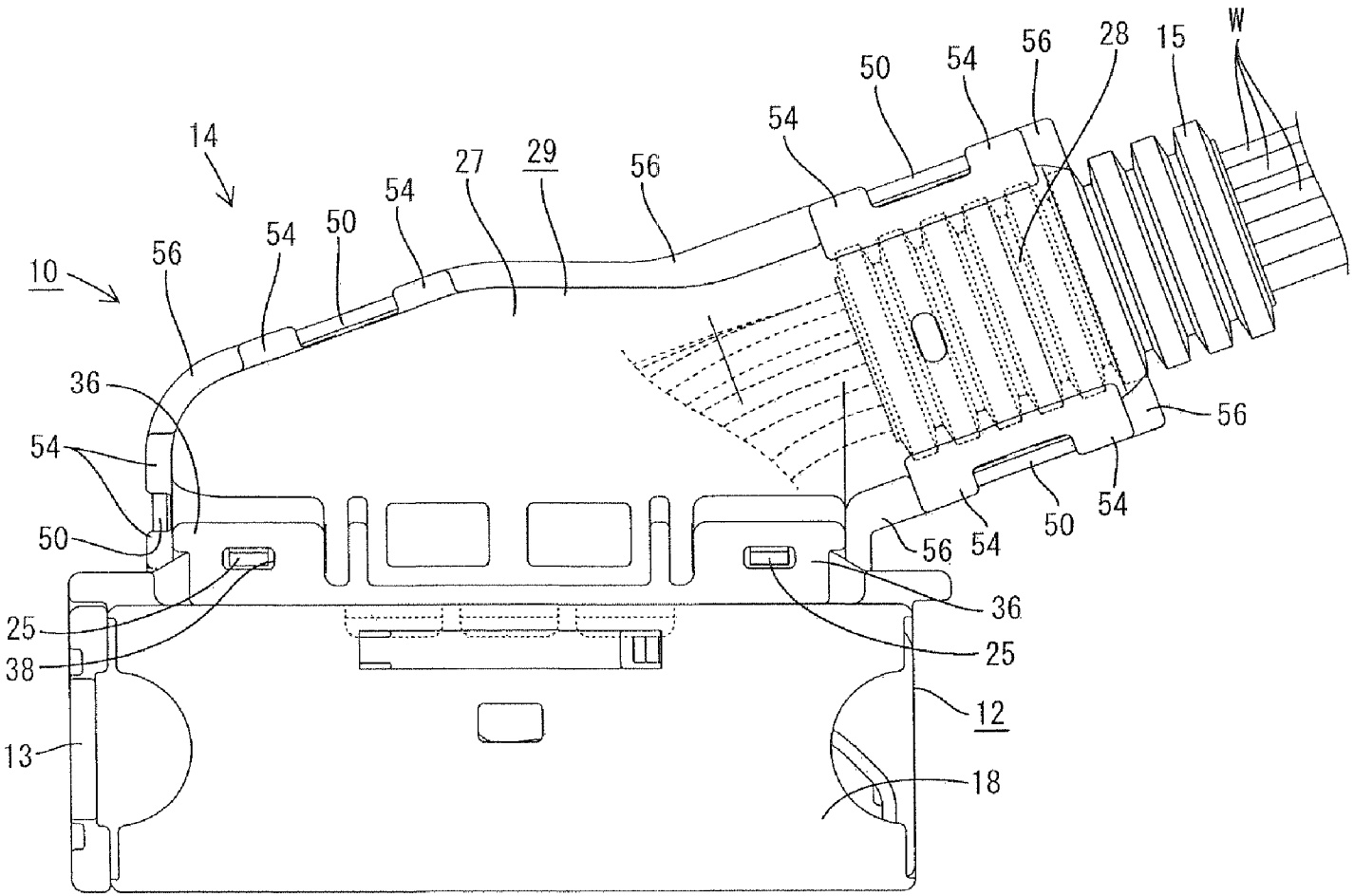
FIG. 1 is a plan view of a connector according to a first embodiment of the invention.
Figure 2:
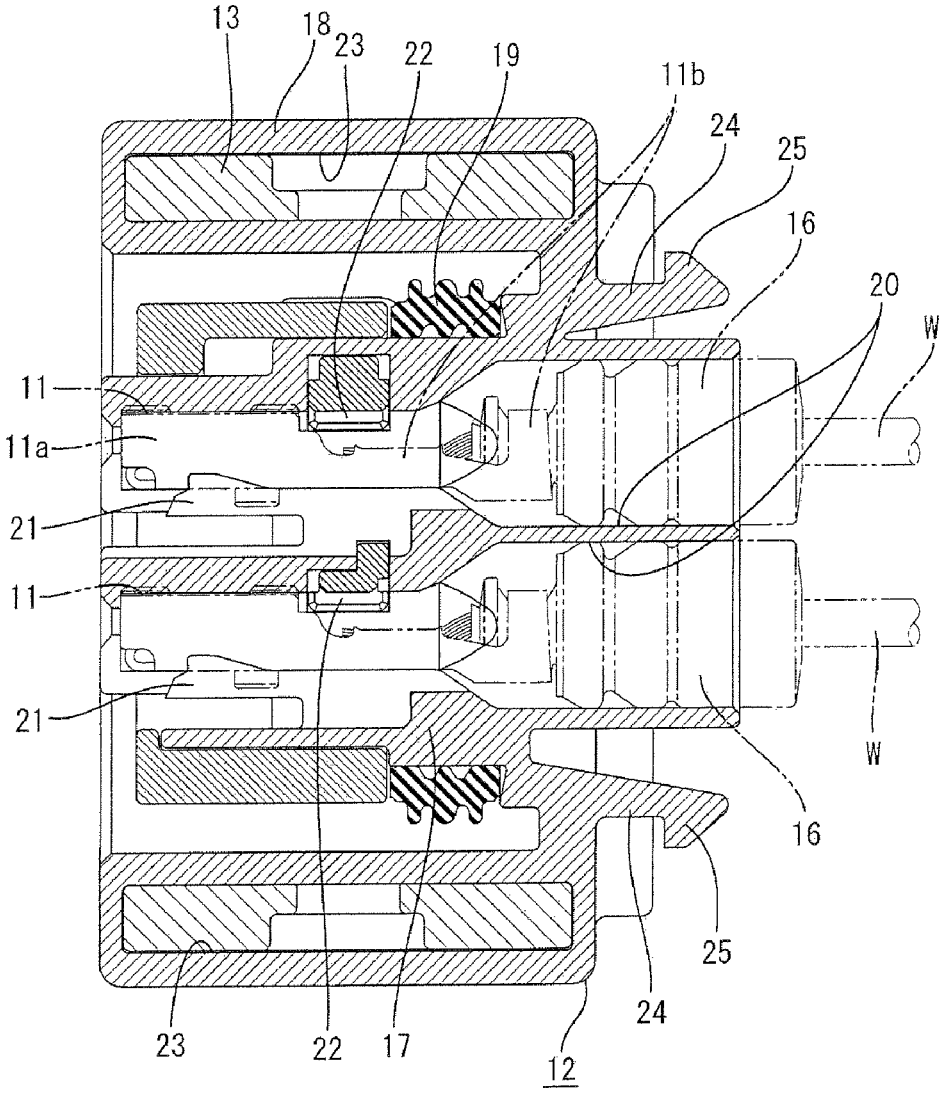
FIG. 2 is a side view in section of a housing.

As shown in FIG. 2, the connector has a plurality of terminal fittings 11 to be connected with ends of wires W and accommodated in a housing 12 for at least partly accommodating the terminal fittings 11. As shown in FIG. 1, a slide lever 13 is mounted laterally to the housing 12 and a cover 14 is mounted on the rear end of the housing 12 to hold a corrugated tube 15.

The corrugated tube 15 is made e.g. of synthetic resin and defines a flexible bellows with alternating projections and recesses. The corrugated tube 15 surrounds and protects the wires W drawn out from the rear of the housing 12 and can be deformed easily in conformity with a layout path of the wires W. The corrugated tube 15 is of substantially circular cross-section, but can have other cross-sectional configurations, such as oval, elliptic, rectangular etc.

Each terminal fitting 11 is formed into a specified shape by press-working a conductive metal plate to form a terminal connecting portion 11*a* connectable with a mating terminal (not shown) and a wire connecting portion 11*b* connectable with the wire W, as shown in FIG. 2. A rear part of the wire connecting portion 11*b* is crimped, bent or folded into connection with a waterproof resilient or rubber plug 16 mounted on an end of the wire W. Two types of terminal fittings 11 of different sizes and/or shapes are prepared.

The housing 12 is made e.g. of synthetic resin and has a wide rectangular parallelepipedic shape, as shown in FIGS. 1 to 4. The housing 12 includes a terminal accommodating portion 17 for accommodating the terminal fittings 11 and an outer wall 18 surrounds the terminal accommodating portion 17. A space between the terminal accommodating portion 17 and the outer wall 18 is open at the front, and a mating housing of an unillustrated mating connector can fit therein from the front. A seal ring 19 is mounted on a rear part of the surface of the terminal accommodating portion 17 facing the outer wall 18 to provide sealing between the housing 12 and the mating housing.

The terminal accommodating portion 17 is substantially block-shaped and has large and small cavities 20 for accommodating the two different sizes of terminal fittings 11. The larger cavities 20 are arranged at opposite end positions of the terminal accommodating portion 17 and the smaller cavities 20 are arranged between the larger cavities 20. The waterproof rubber plug 16 is to be held in close contact with the rear end of the inner circumferential surface of each cavity 20 to provide sealing in the cavity 20. A resiliently deformable locking lance 21 is cantilevered in each cavity for retaining the inserted terminal fitting 11. Further, a retainer 22 is mounted in the terminal accommodating portion 17 and engages parts of the terminal fittings 11 different from the parts engaged by the locking lances 21 to achieve double locking.

Lever accommodation spaces 23 are defined in upper and lower parts of the outer wall 18, as shown in FIG. 2, for accommodating the slide lever 13. The lever accommodation spaces 23 are open at both left and right sides, as shown in FIG. 1, so that the slide lever 13 can be mounted in either direction. The slide lever 13 is substantially U-shaped when viewed from the front or rear, and cam grooves are formed in upper and lower parts of the slide lever 13 for engaging cam pins (not shown) on the mating housing. Although not shown in detail, connecting and separating operations of the housing 12 and the mating housing can be assisted or performed by sliding the slide lever 13 while engaging the cam pins with the cam grooves 13 to display a cam action.

Figure 3:
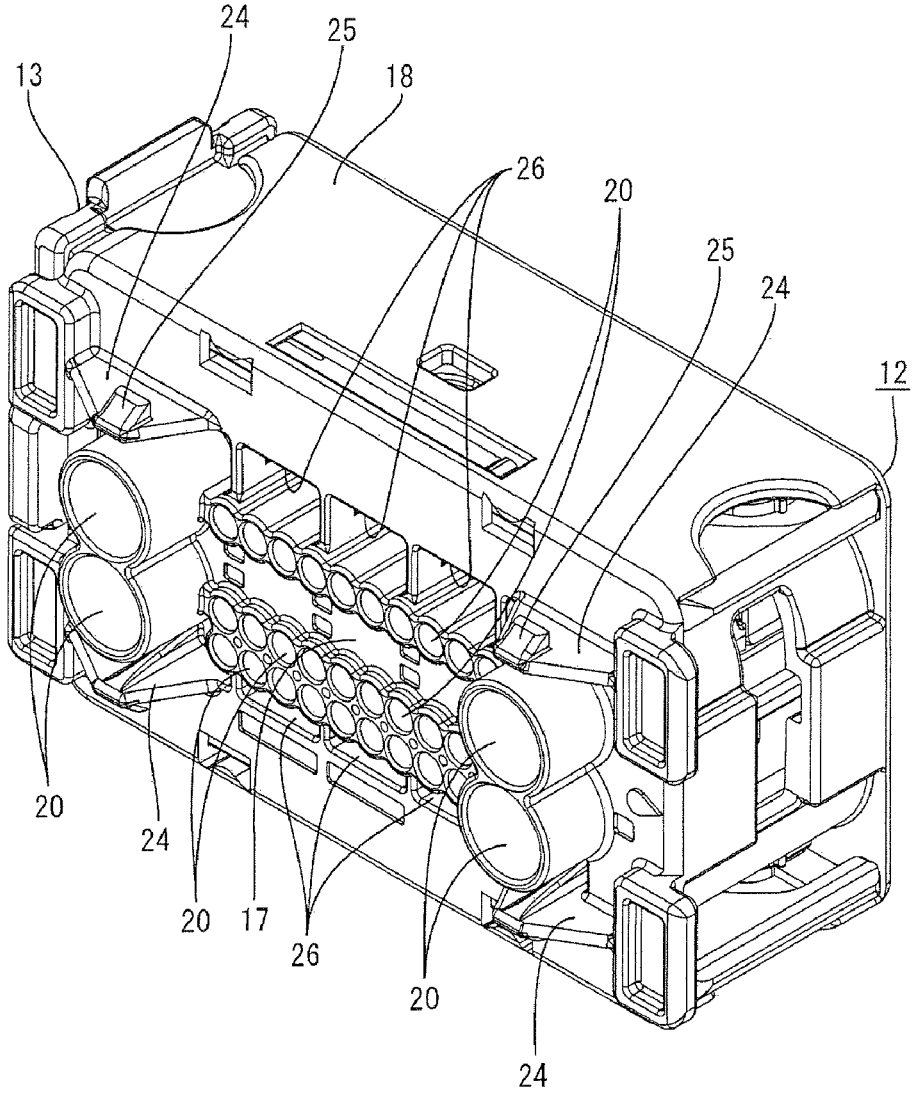
FIG. 3 is a perspective view of the housing.
Figure 4:
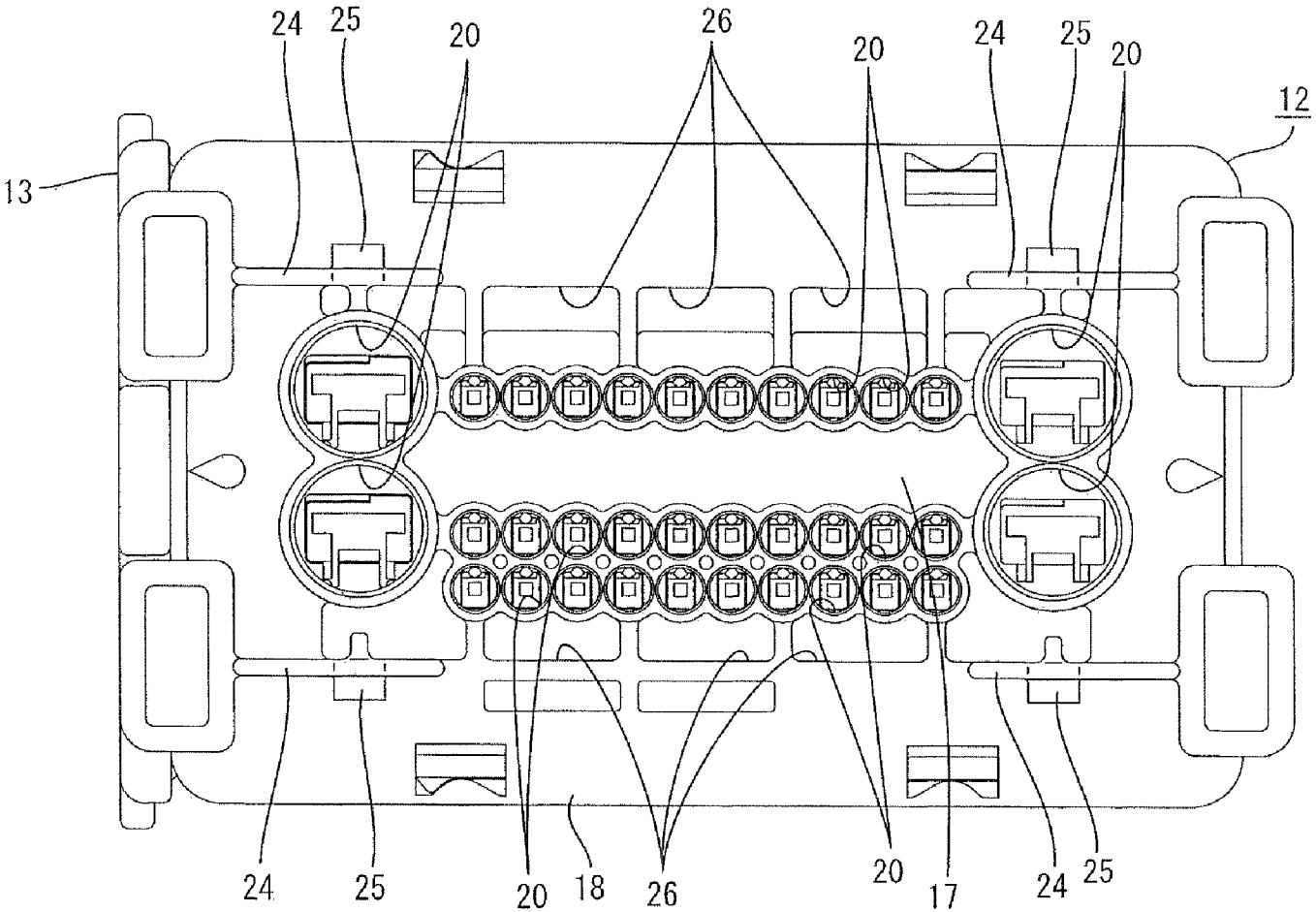
FIG. 4 is a rear view of the housing.

Four plates 24 project back from the rear surface of the housing 12 and are aligned in laterally extending planes, as shown in FIGS. 3 and 4. The plates 24 are arranged near the corners of the rear surface of the housing 12 at positions above and below the larger cavities 20. A cover lock 25 projects out from the surface of each plate 24 opposite the respective cavity 20 and is engageable with the cover 14. Further, three bores 26 are and three bores 26 are formed in the rear surface of the housing 12 at positions below a group of the smaller cavities 20.

The cover 14 is made e.g. of synthetic resin and has a cover main body 27 and a tube holder 28 disposed one after the other, as shown in FIG. 1. The cover main body 27 at least partly surrounds and protects parts of the wires W between the housing 12 and the corrugated tube 15. The tube holder 28 holds the corrugated tube 15.

Figure 5:
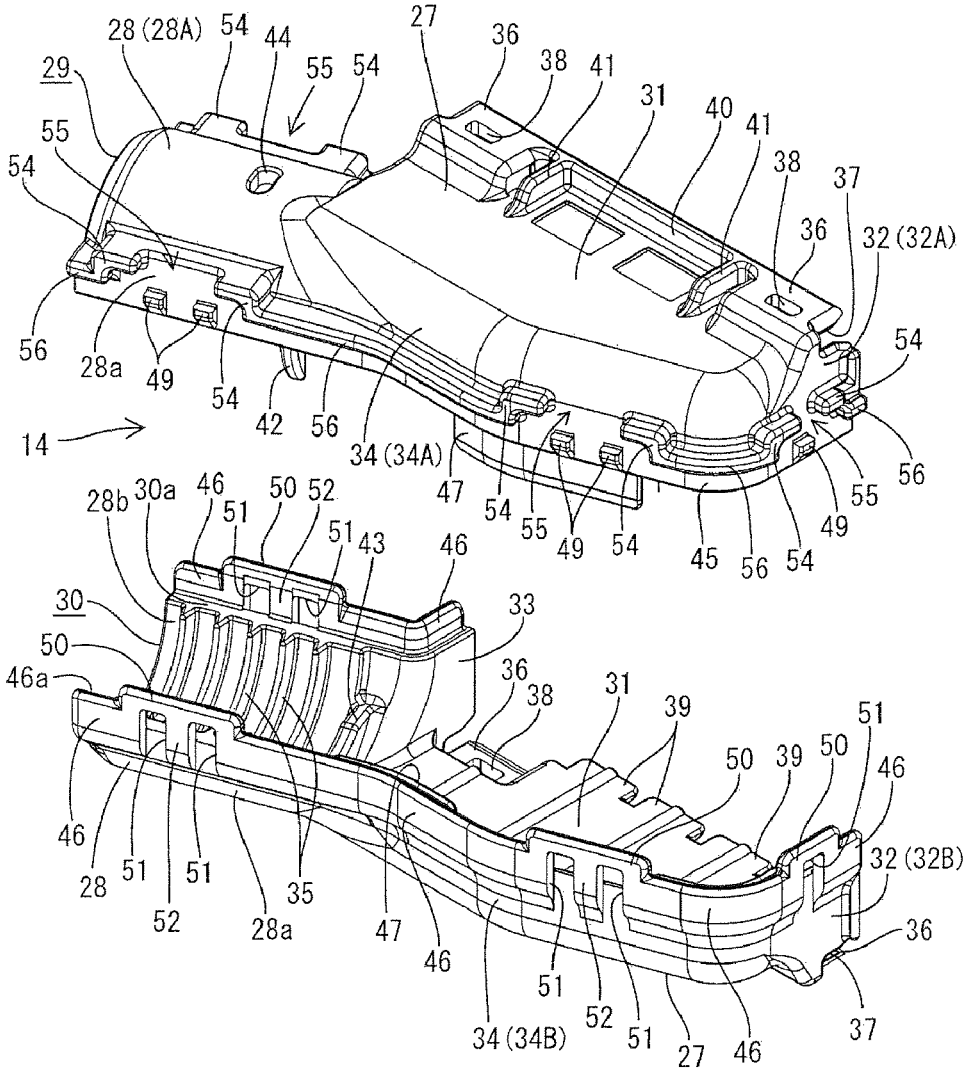
FIG. 5 is an exploded perspective view of a connector cover.

As shown in FIG. 5, the cover 14 is formed by assembling upper and lower cover shells 29, 30 that mate along a horizontal direction at a vertical position to substantially halve the cover 14. An assembling direction of the two cover shells 29, 30 substantially coincides with vertical direction.

Figure 6:
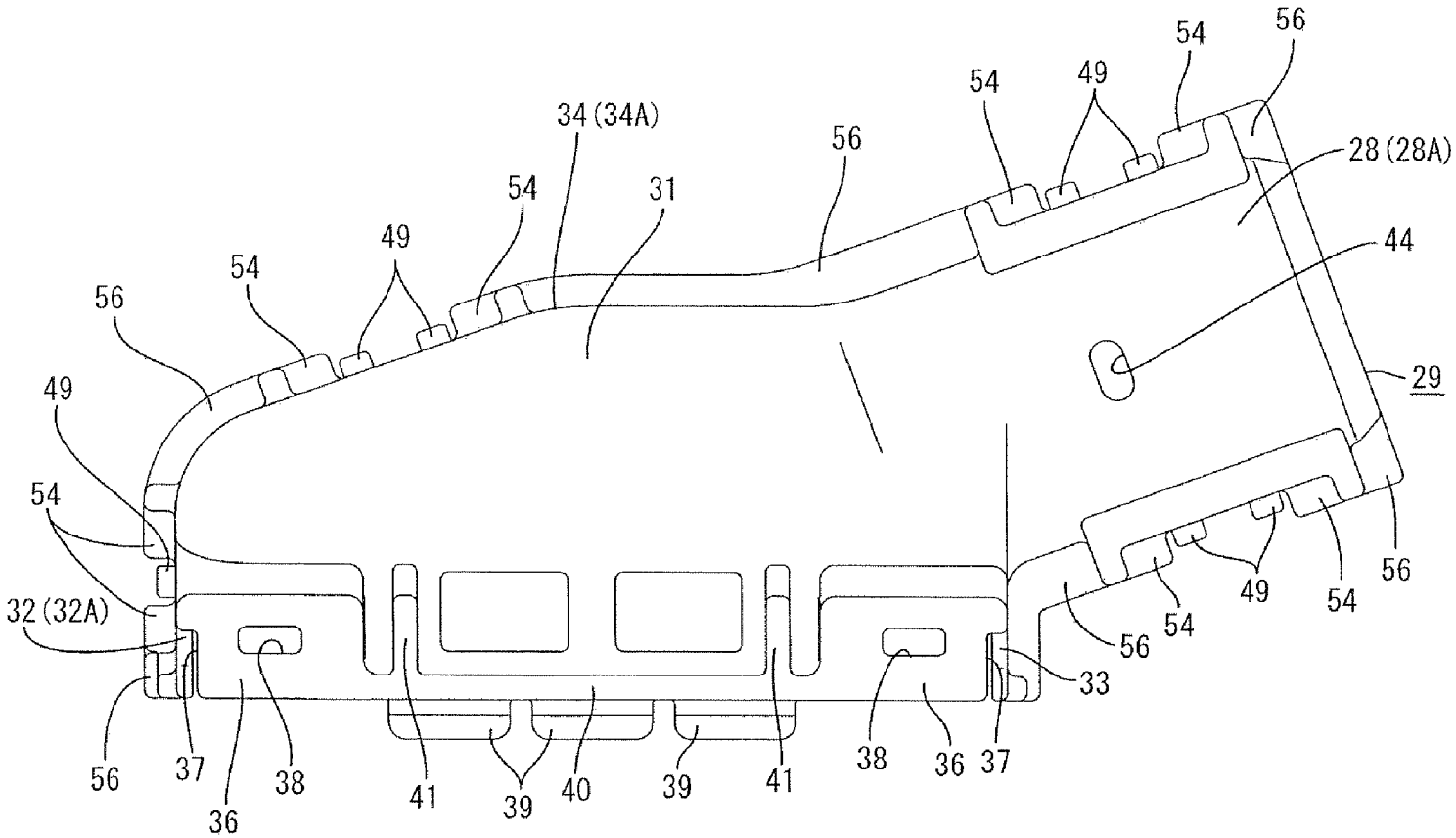
FIG. 6 is a plan view of a first cover-divided part.
Figure 7:
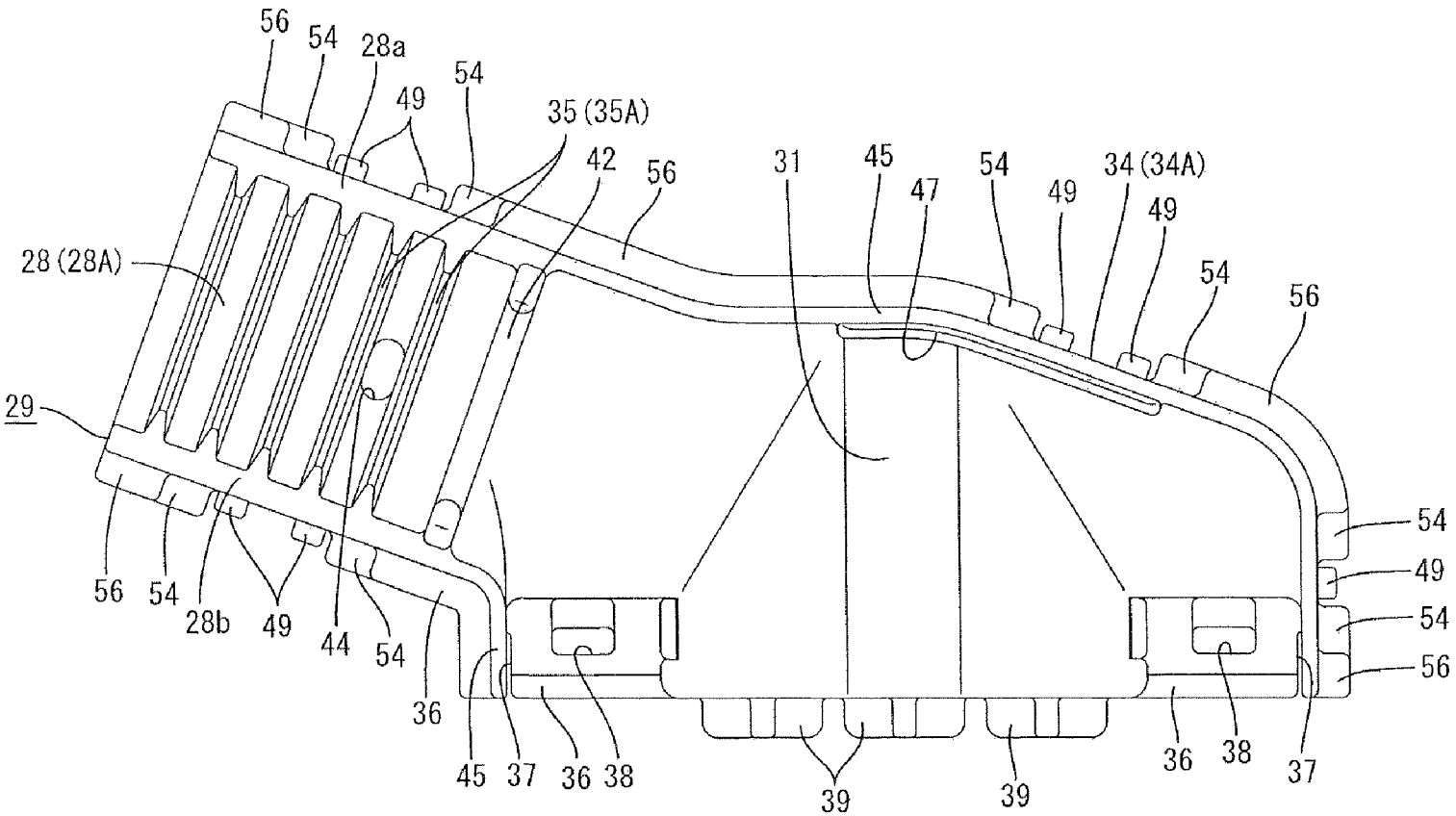
FIG. 7 is a bottom view of the first cover-divided part.
Figure 8:
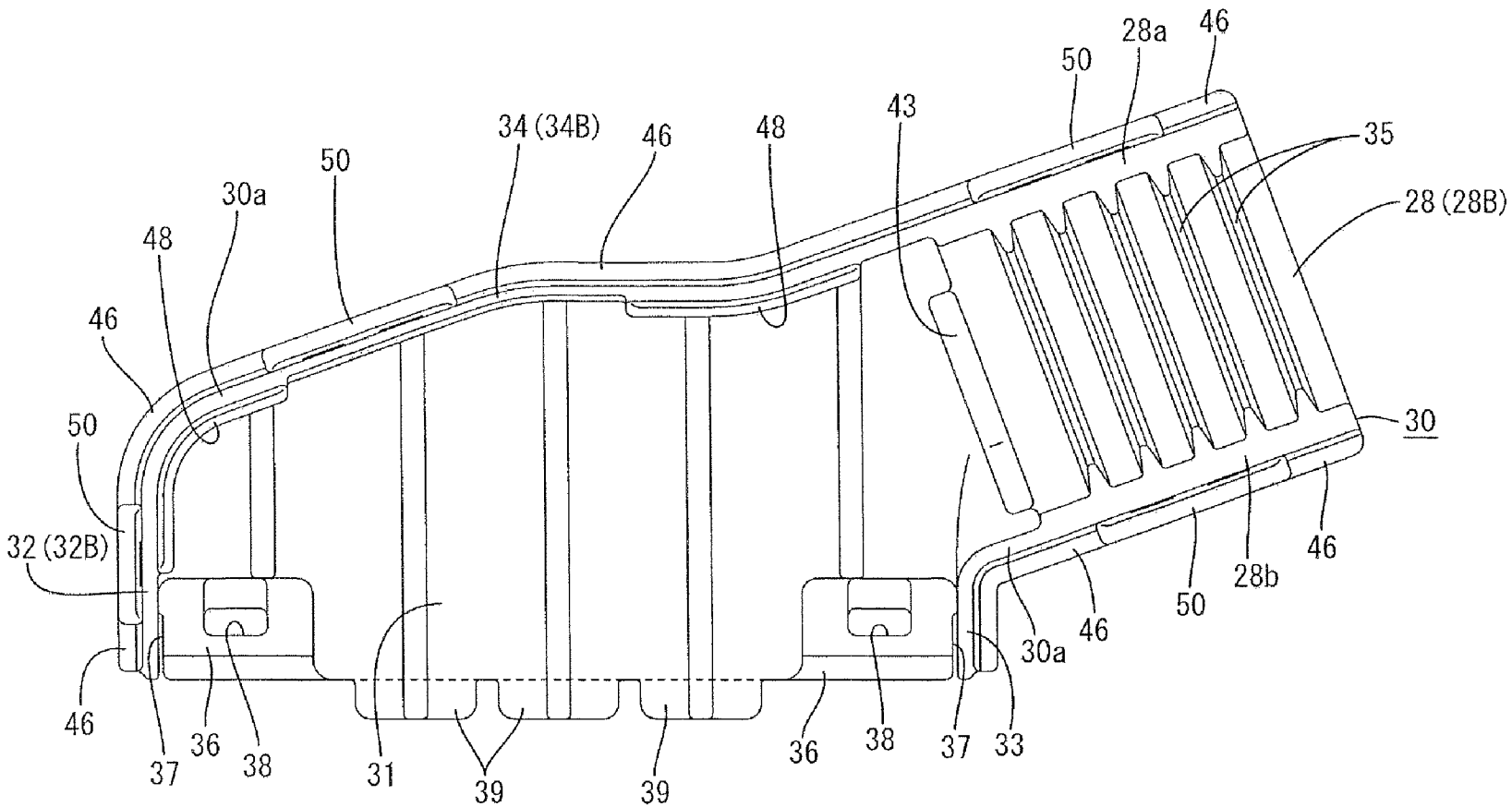
FIG. 8 is a plan view of a second cover-divided part.
Figure 9:
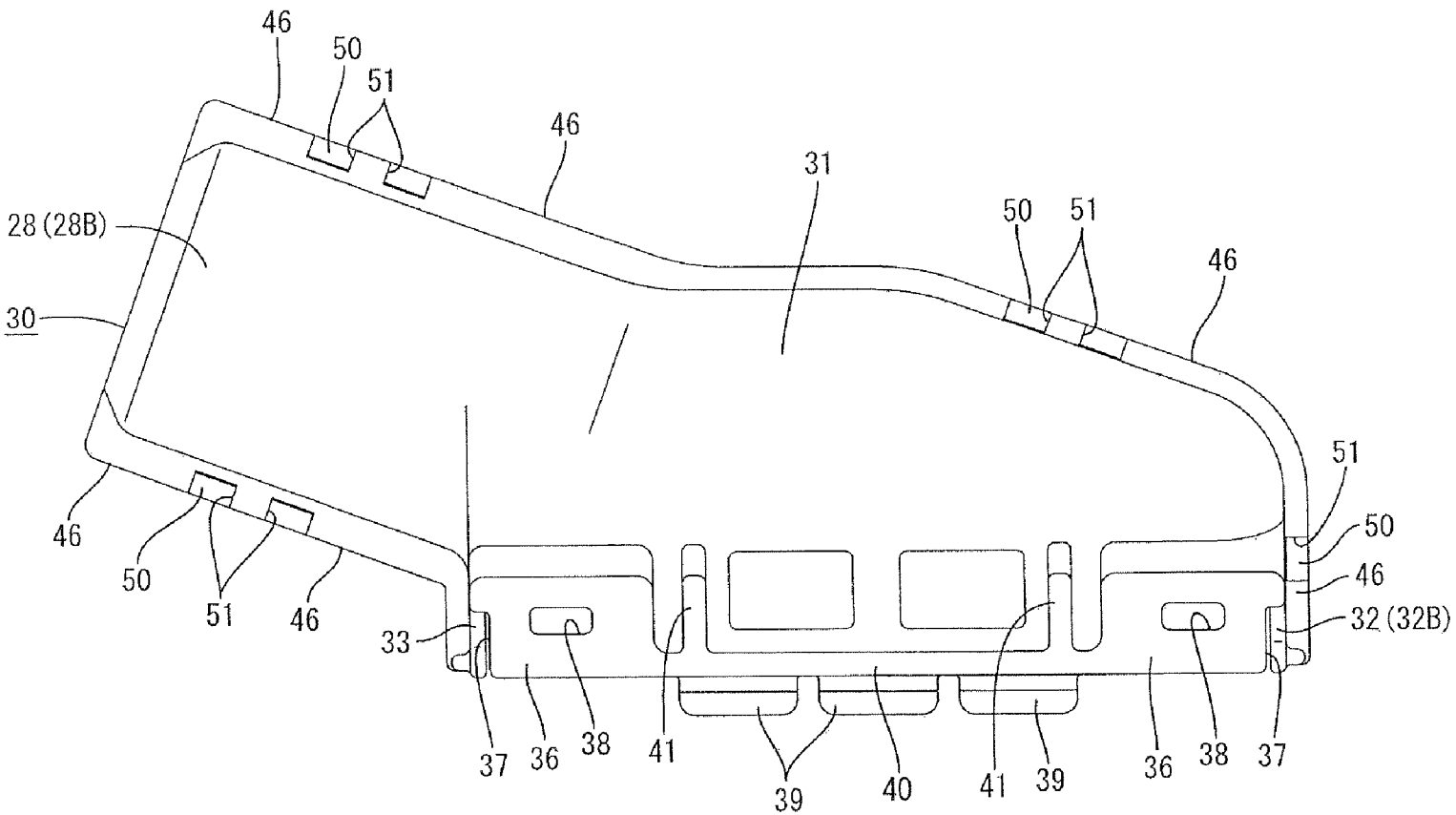
FIG. 9 is a bottom view of the second cover-divided part.
Figure 10:
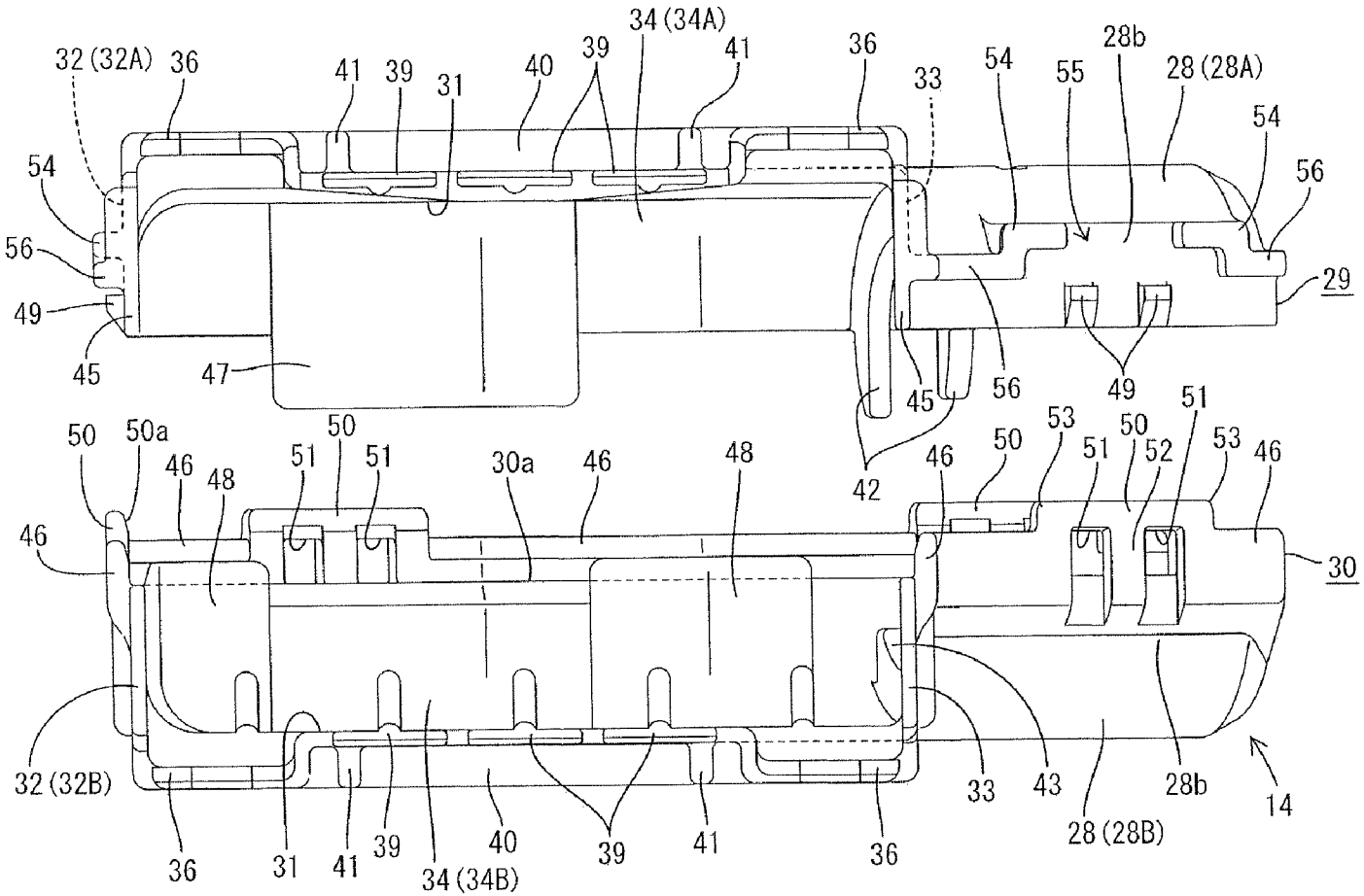
FIG. 10 is a front view of the cover-divided parts before assembly.
Figure 11:
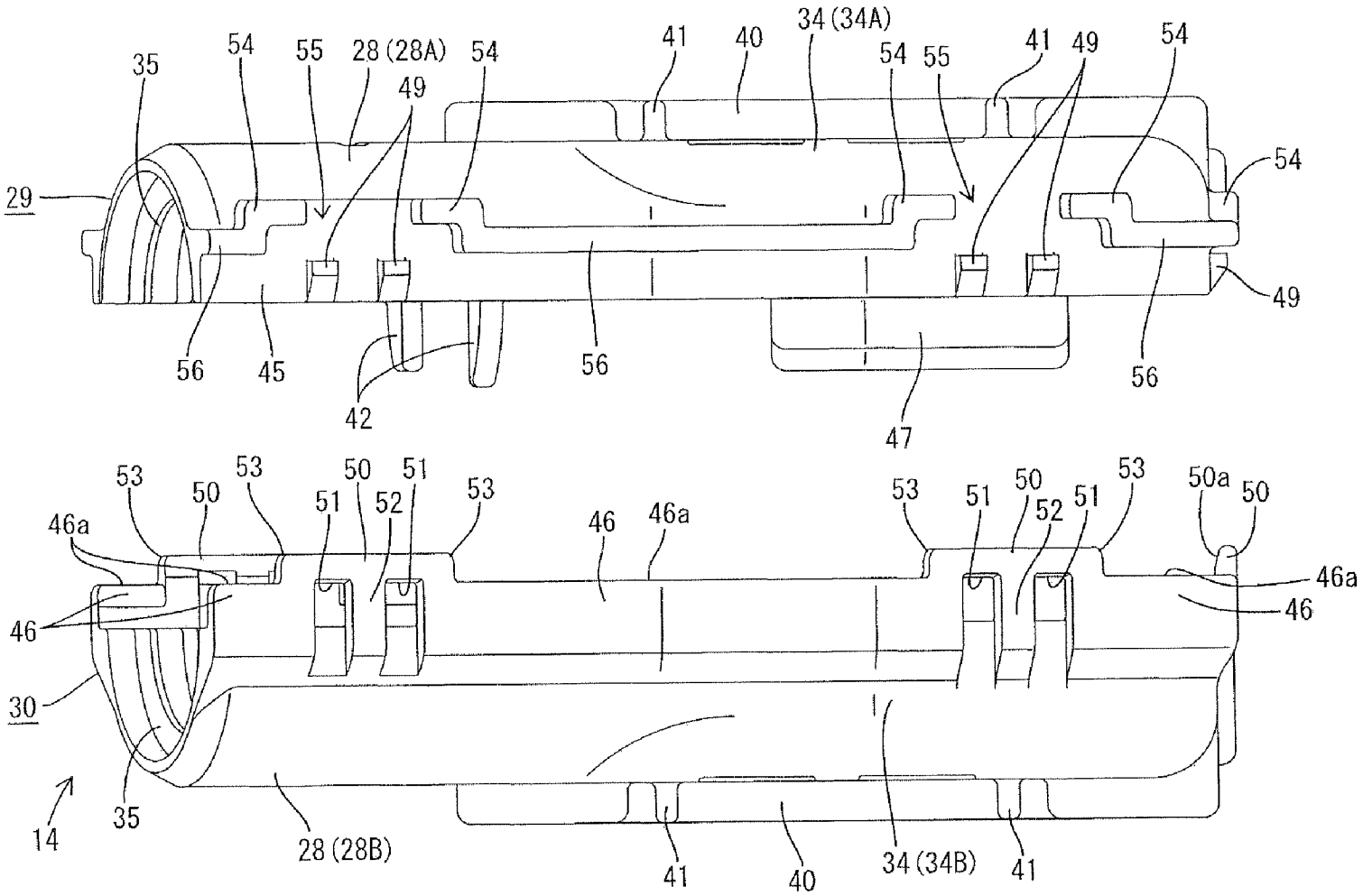
FIG. 11 is a rear view of the cover-divided parts before assembly.
Figure 12:
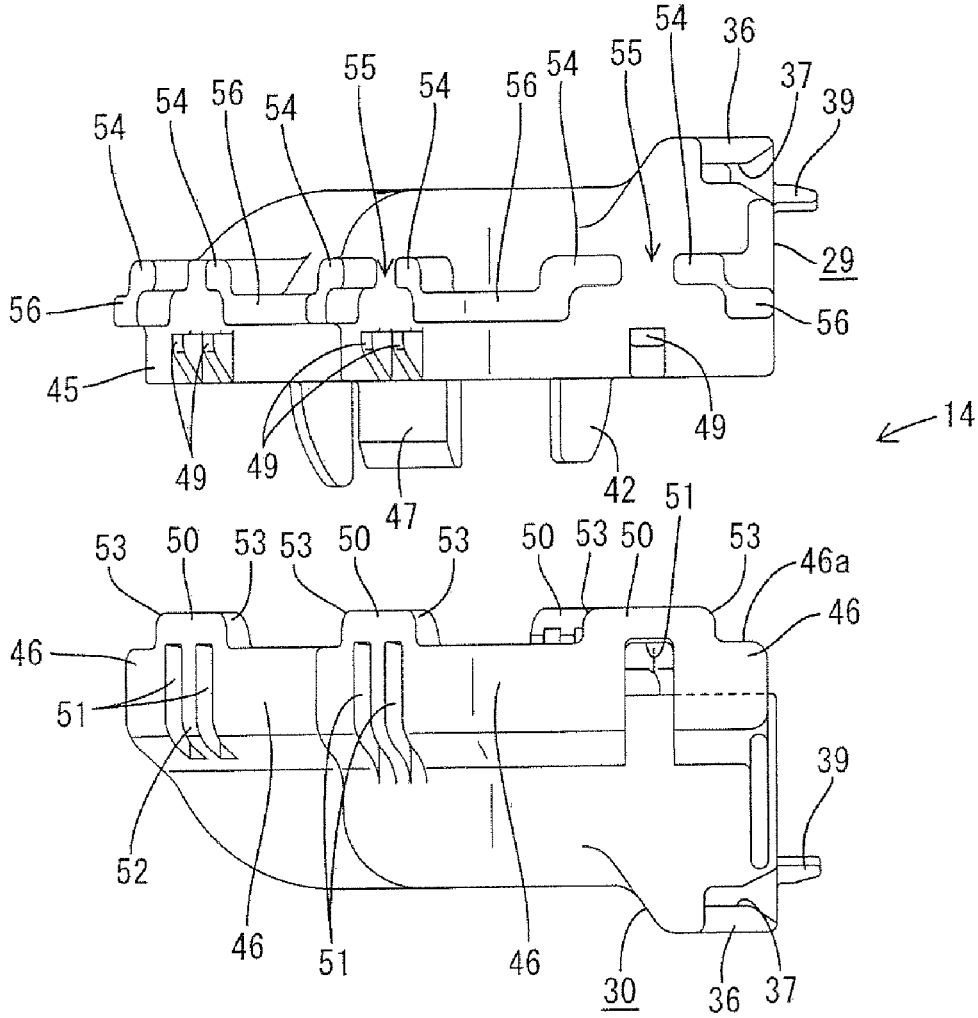
FIG. 12 is a left side view of the cover-divided parts before assembly.
Figure 13:
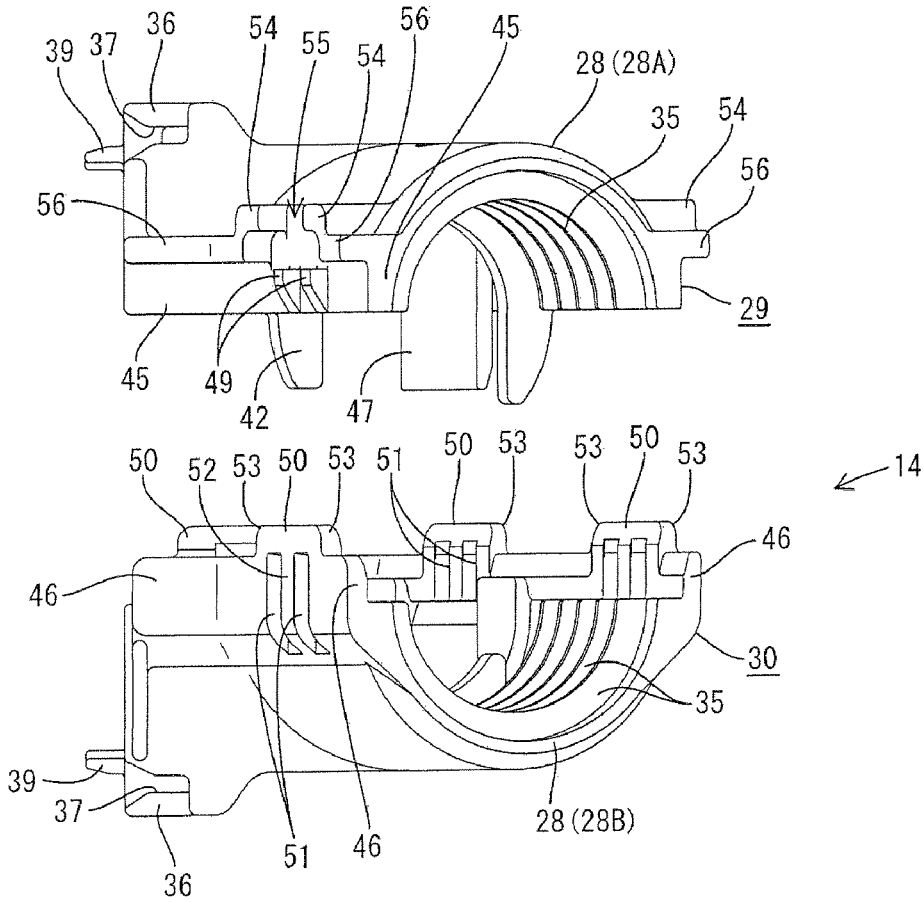
FIG. 13 is a right side view of the cover-divided parts before assembly.

The cover main body 27 has a substantially box shape with an open front. Substantial horizontal main plates 31 extend rearward from the open front, as shown in FIGS. 6 to 10. A left side plate 32 extends between sides of the main plates 31 opposite the tube holder 28 and a right side plate extends between sides of the main plates 31 adjacent the tube holder 28. A rear plate 34 extends between rear ends of the main plates 31 and continues from the rear end of the left side plate 32 to the tube holder 28, as shown in FIGS. 6 and 8. Parts of the rear plate 34 at the left side plate 32 and at the tube holder 28 are oblique to the lateral direction in plan view. However, an intermediate part of the rear plate 34 is straight along the lateral direction. The side plates 32, 33 and the rear plate 34 extend substantially vertically in the assembling direction upper and lower cover shells 29, 30.

The tube holder 28 is substantially in the form of a cylindrical tube in conformity with the shape of the corrugated tube 15. The front end of the tube holder 28 is connected with rear lateral part of the cover main body 27. More particularly, the tube holder 28 is connected with the rear end of the right side plate 33 in FIGS. 6 and 8, the right end of the rear plate 34 in FIGS. 6 and 8 and the right end parts of the both main plates 31 behind the right side plate 33. Additionally, the tube holder 28 extends obliquely back and to the right in FIGS. 6 and 8 from the cover main body 27 when viewed from above, and an angle of inclination to the lateral direction substantially coincides with the angle of the inclined part of the rear plate 34. Locking ribs 35 extend at least partly around the inner circumferential surface of the tube holder 28 and project sufficiently in for engaging recesses in the outer circumferential surface of the corrugated tube 15. Five locking ribs 35 are arranged one after another while being spaced from each other in the extending direction of the tube holder 28. Lateral portions 28*a*, 28*b* of the tube holder 28 extend substantially vertically and are divided into upper and lower parts.

Four housing locking pieces 36 are provided at the front ends of the main plates 31 of the cover main body 27 in proximity to the respective corners of the front end of the cover 14. The housing locking pieces 36 are disposed and configured for engaging the cover locks 25 of the housing 12 to hold the cover 14 on the housing 12. More particularly, the housing locking pieces 36 bulge out from the opposite lateral ends of the front end of the main plates 31, and are made flexible by forming forwardly open slits 37 between the housing locking pieces 36 and the adjacent side plates 32, 33. The respective plates 24 of the housing 12 are insertable into the slits 37. A wide locking hole 28 penetrates an intermediate position of each housing locking piece 36 in the thickness direction, and the corresponding cover lock 25 can be fit into the lock hole 38 to engage the circumferential surfaces thereof.

Water blocking pieces 39 project forward from an intermediate part of the front end of each main plate 31 of the cover main body 27. The water blocking pieces 39 are wide and are arranged substantially side by side in the lateral direction and are insertable into the bores 26 of the housing 12. Thus, the water blocking pieces 39 can guide an operation of mounting the cover 14 on the housing 12 and, even if aqueous fluid such as washing water is injected at high pressure from the outside in a mounted state, can make it difficult for the aqueous fluid to enter the inside due to its form of a labyrinth seal through a clearance between the rear end surface of the housing 12 and the front end surface of the cover 14. Water blocking walls 40 extend up or down at intermediate parts of the front ends of both main plates 31 to prevent the entry of aqueous fluid. The opposite ends of the water blocking walls 40 are connected with ends of the housing locking pieces 36. Further, reinforcing ribs 41 are connected with the rear ends of the opposite ends of each water blocking wall 40.

In the following description, a suffix A is attached to the reference numerals relating to the first cover shell 29 and a suffix B is attached to those relating to the second cover shell 30 for distinguishing the cover shells 29, 30, whereas no suffixes are attached when referring to the cover shells generically.

Figure 14:
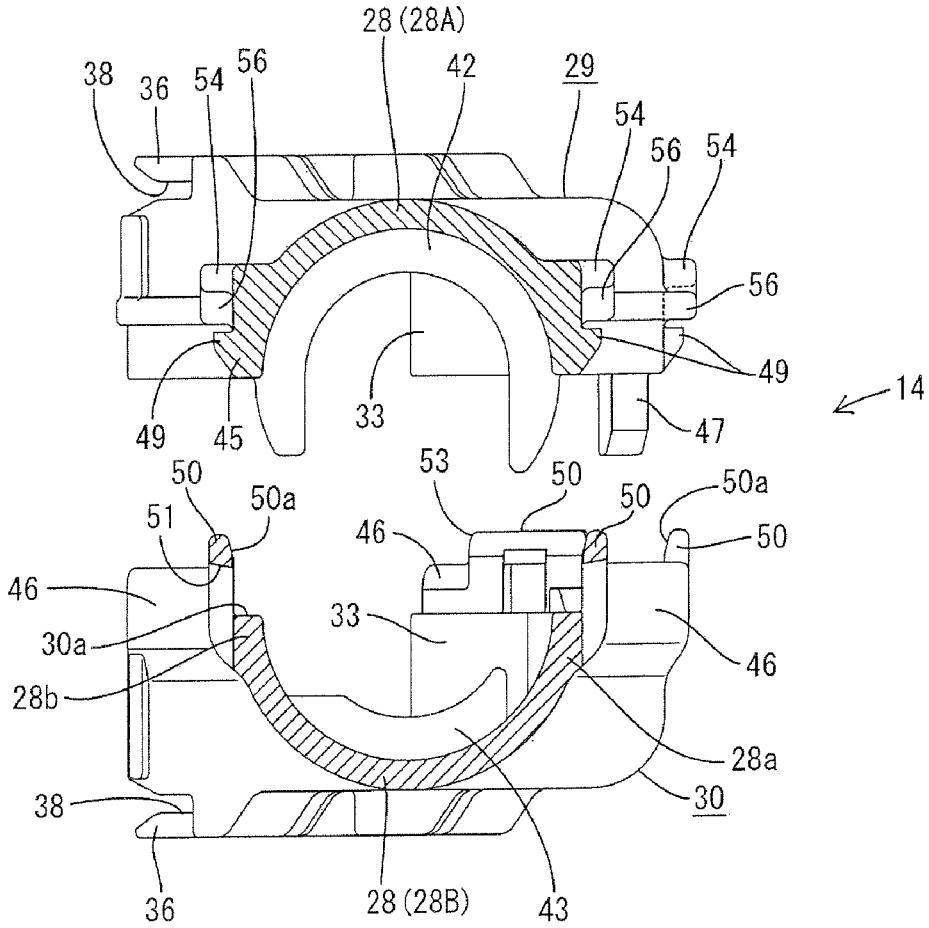
FIG. 14 is a horizontal section of tube holding portions of the both cover-divided parts before being assembled.
Figure 15:
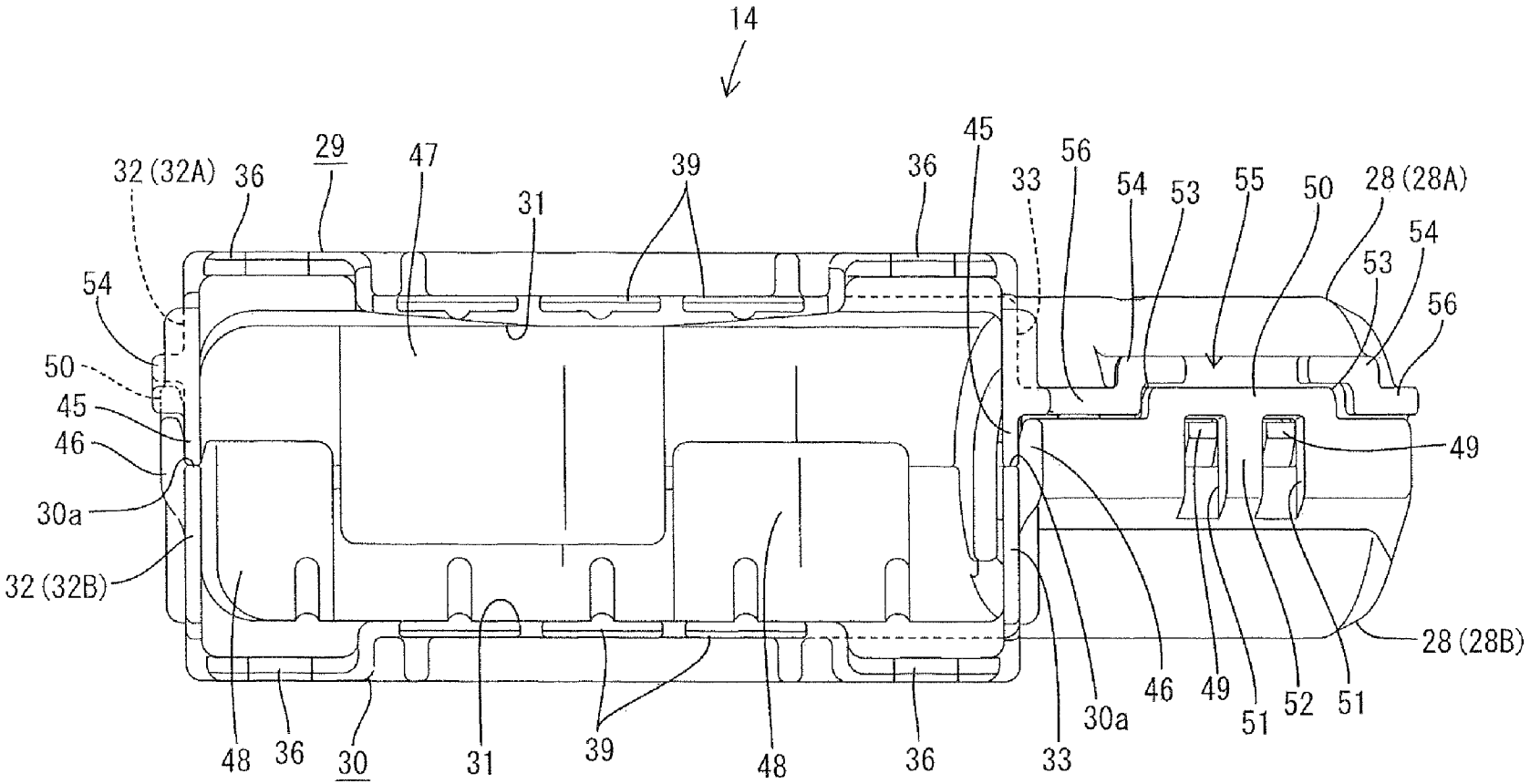
FIG. 15 is a front view of the assembled cover-divided parts.
Figure 16:
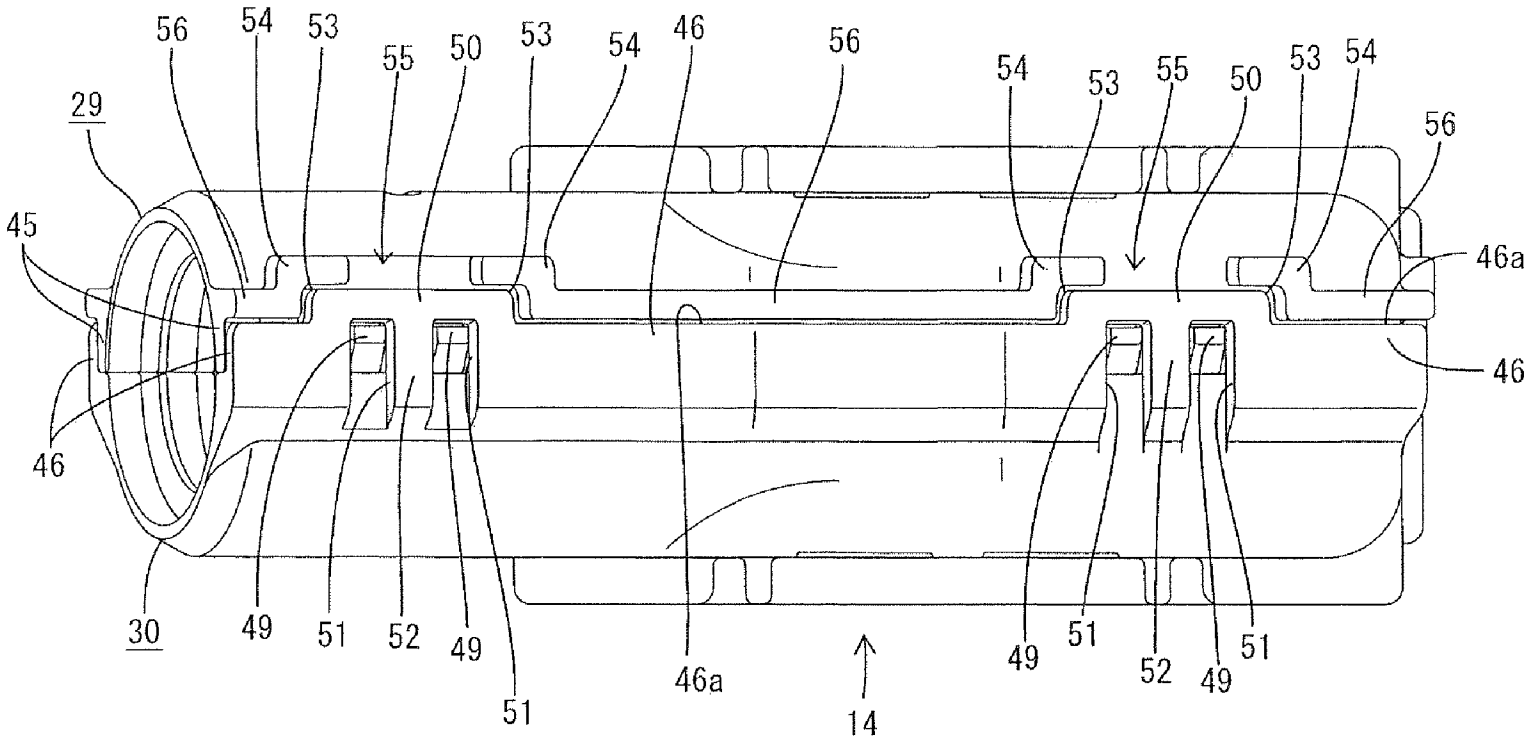
FIG. 16 is a rear view of the assembled cover-divided parts.
Figure 17:
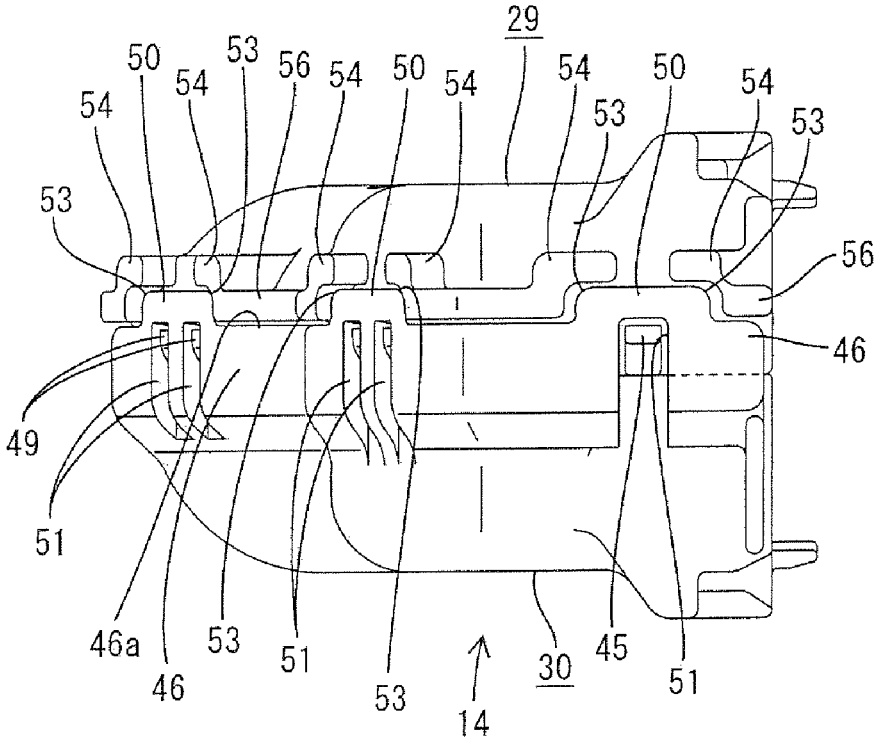
FIG. 17 is a left side view of the assembled cover-divided parts.
Figure 18:
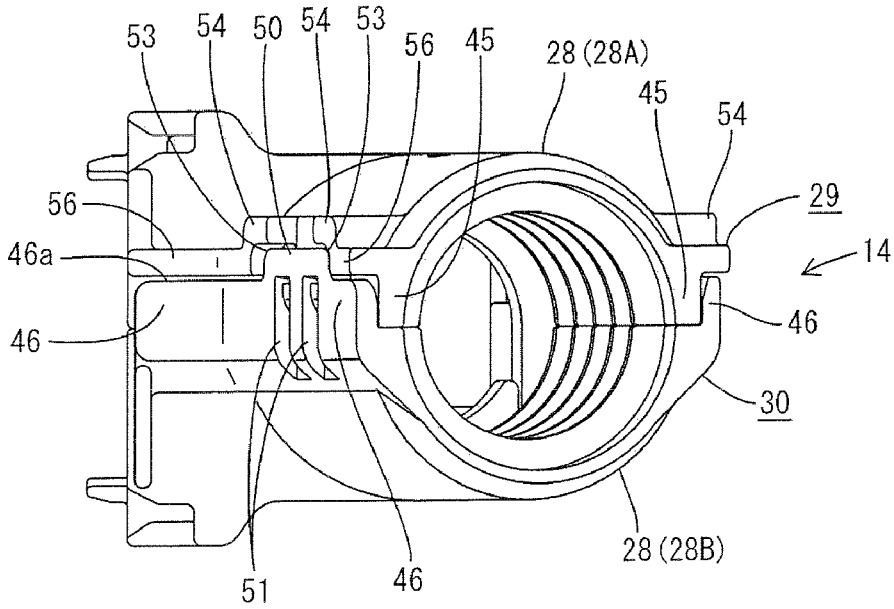
FIG. 18 is a right side view of the assembled cover-divided parts.

First and second wire holders 42 and 43 are provided respectively on the inner surfaces of the first and second cover shells 29, 30 near boundaries between the tube holder 28 and the cover main body 27 for holding a bundle of the wires W exposed from the front end of the corrugated tube 15. The first and second wire holders 42, 43 project radially in from the inner surfaces of the respective cover shells 29, 30 and extend in circumferential directions. As shown in FIG. 14, the first wire holder 42 is substantially U-shaped when viewed from the front, and has opposite ends that project towards the mating second cover shell 30 in the assembling direction from a division end surface of the first cover shell 29. On the other hand, the second wire holder 43 is provided at an intermediate position on the inner circumferential surface of the second cover shell 30 while leaving escape spaces for the opposite ends of the first wire holder 42. The inner edge of the second wire holder 43 is substantially arcuate.

Figure 19:
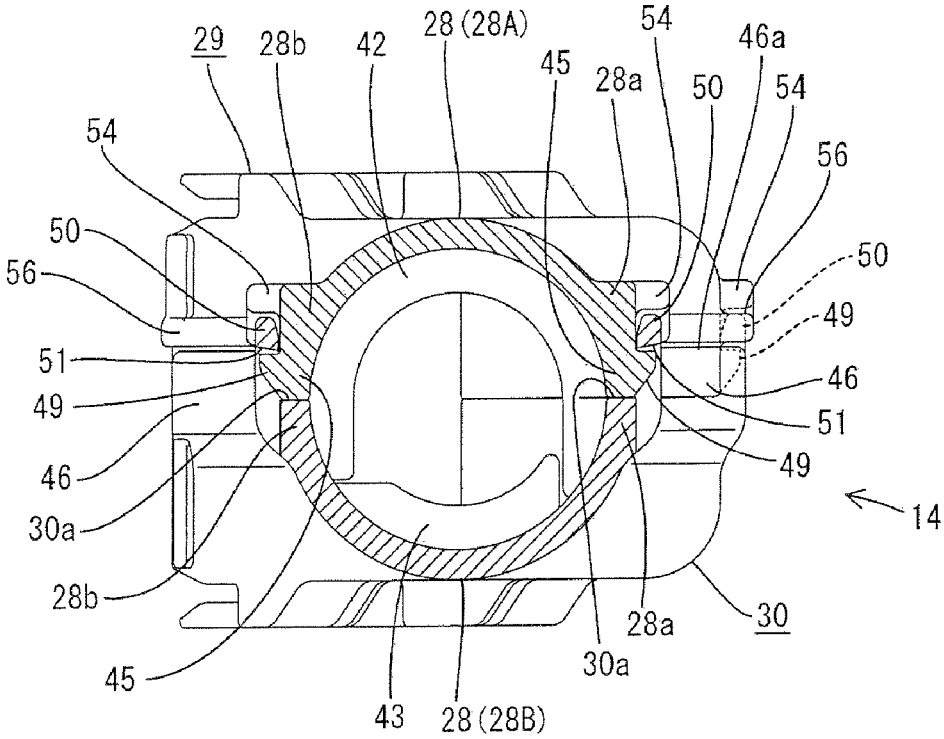
FIG. 19 is a horizontal section of the tube holding portions of the both cover-divided parts in the assembled state.

The first and second wire holders 42, 43 form a substantially annular shape surrounding the bundle of the wires W when the cover shells 29, 30 are assembled and a space slightly larger than the cross-sectional area of the bundle of the wires W is defined inside (see FIG. 19). The inner edges of the first and second wire holders 42, 43 project radially in farther than the inner edge of the front end of the corrugated tube 15 to prevent the held wires W from being damaged by the end of the corrugated tube 15. Further, the corrugated tube 15 can be positioned with respect to the cover 14 by the contact of the front end of the corrugated tube 15 with the first and/or second wire holders 42, 43. At least one water drainage hole 44 penetrates the tube holder 28A of the first cover shell 29 between the frontmost locking rib 35A and the succeeding locking rib 35A, as shown in FIGS. 6 and 7.

As shown in FIG. 5, first and second overlapping walls 45, 46 are provided at division end portions of the first and second cover shells 29, 30 and are placed one inside the other as the first and second cover shells 29, 30 are assembled. More specifically, the first and second overlapping walls 45, 46 are formed along substantially the entire wall portions of the respective cover shells 29, 30 extending in the assembling direction, i.e. longer side portions from the left side plate 32 to the rear lateral portion 28*a* of the tube holder 28 via the rear plate 34 shown in FIGS. 6 and 8 and shorter side portions from the right side plate 33 to the front lateral portion 28*b* of the tube holder 28.

The first overlapping walls 45 extend down in the assembling direction from the walls of the first cover shell 29 towards the mating second cover shell 30. On the contrary, the second overlapping walls 46 project out horizontally and substantially orthogonal to the assembling direction from leading ends 30*a* of the walls of the second cover shell 30 and then project up in the assembling direction and towards the mating first cover shell 29. Accordingly, at the time of assembling, the second overlapping walls 46 are placed outside the first overlapping walls 45 and the leading ends of the first overlapping walls 45 contact the leading ends 30*a* of the walls of the second cover shell 30.

A wire receiving piece 47 is provided on the inner surface of the first overlapping wall 45 of the first cover shell 29 for receiving the wires W bent in the cover main body 27. The wire receiving piece 47 is a substantially rectangular plate that projects substantially horizontally in from the first overlapping wall 45 and then projects down in the assembling direction. The wire receiving piece 47 is formed in a range of the rear plate 34A extending from the front part that is inclined to lateral direction to the intermediate part that is straight in the lateral direction. Additionally, the wire receiving piece 47 is bent moderately at its intermediate position along the rear plate 34 and the first overlapping wall 45. The wires W bent in the cover main body 27 are pressed inwardly in horizontal direction by the wire receiving piece 47.

Guiding walls 48 are provided on the rear plate 34B and the left side plate 32B shown in FIG. 8 of the second cover shell 30 for guiding the first cover shell 29 during assembly. The guiding walls 48 project substantially horizontally in from the leading ends of the rear plate 34B and the side plate 32B and then project up in the assembling direction. In other words, the guiding walls 48 face the second overlapping wall 46 from the outer side while defining spaces with a thickness substantially equal to that of the first overlapping wall 45. Accordingly, the first overlapping wall 45 of the first cover shell 29 is held between the guiding walls 48 and the second overlapping wall 46 during assembly to position the first overlapping wall 45. The two guiding walls 48 are arranged to be at opposite sides of the wire receiving piece 47 of the first cover shell 29. The left guiding walls 48 shown in FIG. 8 extends from the rear plate 34B to the left side plate 32B and is bent in conformity with the shapes of the rear plate 34B and the left side plate 32B. The right guiding wall 48 in FIG. 8 extends from the intermediate part of the rear plate 34B substantially straight in the lateral direction and the rear part thereof is inclined laterally and bent moderately at its intermediate position along the rear plate 34B.

As shown in FIG. 5, the first cover shell 29 includes locks 49 and the second cover shell 30 includes lock pieces 50 that engage the respective locks 49 for holding the two cover shells 20, 30 assembled. The locks 49 and the corresponding lock pieces 50 are provided at plural positions substantially equally spaced apart in the circumferential direction at the division end portions of the cover shells 29, 30. More specifically, a pair of the locks 49 and the lock pieces 50 is provided to correspond to the tube holder 28 and another pair is provided to correspond to the left side plate 32 at the division end portions of the cover shells 29, 30, as shown in FIGS. 6 and 8. The tube holder 28 can be locked strongly by providing one pairs of the locks 49 and the lock piece 50 at each of the opposite sides of the tube holder 28.

The locks 49 project substantially horizontally out from the outer surfaces of the first overlapping walls 45 of the first cover shell 29. Each lock 49 is substantially block-shaped, and has a slanted front surface with respect to the assembling direction to guide a movement of the lock piece 50 thereon. The rear surface of each lock 49 with respect to the assembling direction extends substantially straight in the horizontal direction. The locks 49 are provided near front end positions of the first overlapping walls 45 with respect to the assembling direction.

Only one lock 49 is provided at a part of the first overlapping wall 45 projecting from the left side plate 32A shown in FIG. 6. However, the locks 49 are provided in twos at other parts, including parts of the first overlapping walls 45 projecting from the both lateral portions 28*a*, 28*b* of the tube holder 28A and a part thereof projecting from the rear plate 34A. The pairs of locks 49 are spaced apart from each other by specified distances corresponding to the width of reinforcements 52 to be described later.

The lock pieces 50 extend unitarily from the leading ends 46*a* of the second overlapping walls 46 towards the mating first cover shell 29 in the assembling direction. In this way, the springiness, resiliency or flexibility of the lock pieces 50 is ensured. The lock pieces 50 are resiliently deformable to open in laterally in directions intersecting with the assembling direction.

The lock pieces 50 are formed with lock grooves 51 for receiving the respective locks 49. The lock grooves 51 are closed at the leading ends of the lock pieces 50, but are open at the bottom ends. The locks 49 are engaged with the upper groove edges. Leading ends of the lock pieces 50 are tapered to define slanted inner surfaces 50*a* to guide movements of the lock pieces 50 onto the locks 49.

The lock pieces 50 corresponding to the lateral portions 28*a*, 28*b* of the tube holder 28B and corresponding to the rear plate 34B are wider than the lock piece 50 corresponding to the left side plate 32B of FIG. 8. Two lock grooves 51 are formed in these three wider lock pieces 50. Thus, the corresponding two locks 49 are engaged with the wider lock pieces 50 at once. Reinforcements 52 are formed on the outer surface of the tube holder 28B and the rear plate 34B at positions between the two lock grooves 51 of each wider lock piece 50 to reinforce the wider lock pieces 50. The narrower lock piece 50 at a frontmost position in the second cover shell 30 is located slightly behind the front end of the second overlapping wall 46. Similarly, the two wider lock pieces 50 corresponding to the tube holder 28B and located at the rearmost positions in the second cover shell 30 are located slightly before the rear ends of the second overlapping walls 46.

The first cover shell 29 has locking-piece protectors 54 for protecting leading free end corners 53 of the lock pieces 50 in an assembled state, as shown in FIG. 5. The lock-piece protectors 54 are formed on the outer surface of the first cover shell 29 at positions adjacent to the leading end corners 53 of the respective lock pieces 50 and project out horizontally in the thickness directions of the lock pieces 50 from the outer surface of the first cover shell 29 to face the leading ends 53 of the respective lock pieces 50 in the assembled state (see FIG. 19). The lock-piece protectors 54 have a horizontal projecting distance to reach the outer side of the lock pieces 50 in the assembled state.

More specifically, the lock-piece protectors 54 are provided on both lateral portions 28*a*, 28*b* of the tube holder 28A, the rear plate 34A and the left side plate 32A shown in FIG. 6 of the first cover shell 29. Two lock-piece protectors 54 are arranged at a distance from each other at positions corresponding to the opposite leading end corners 53 of each lock piece 50. The leading end surface of each lock piece 50 is exposed in the assembling direction through a disengagement space 55 between the paired lock-piece protectors 54. The disengagement space 55 is used for disengaging the lock piece 50. A distance between the paired lock-piece protectors 54 coincides with the formation range of the corresponding locks 49 in the width direction (including an interspace if two locks 49 are arranged substantially side by side). In other words, the lock-piece protectors 54 have a positional relationship so as not to be opposed to the locks 49 in the assembling direction and to be deviated from the locks 49 in horizontal direction, which is orthogonal to the assembling direction.

Each lock-piece protector 54 has a substantially vertical part and a substantially horizontal part joined to define an L-shaped that partly surrounds the leading end corner 53 of the lock piece 50. In other words, the lock-piece protectors 54 are present at least at positions diagonally opposite to the corresponding leading end corners 53. The leading end surfaces and lateral end surfaces of the lock pieces 50 are covered at least partly from the outside at once by the lock-piece protectors 54. In the assembled state, clearances between the lock-piece protectors 54 and the lock pieces 50 are smaller than the outer diameter of the wires W.

The first cover shell 29 has overlapping-wall protectors 56 to be arranged outside the first overlapping walls 45 after assembly for protecting the second overlapping walls 46. The overlapping-wall protectors 56 are at positions on the outer surface of the first cover shell 29 for substantially abutting the leading ends 46*a* of the second overlapping walls 46 after assembly and to project horizontally out in the thickness directions of the second overlapping walls 46 from the outer surface of the first cover shell 29 to face the second overlapping walls 46. The projecting distance of the overlapping-wall protectors 56 is set so that the overlapping-wall protectors 56 are more outward than the second overlapping walls 46 in the horizontal or thickness directions of the second overlapping walls 46 in the assembled state.

The overlapping-wall protectors 56 are ribs extending straight along the leading ends of the second overlapping walls 46 on the outer surface of the first cover shell 29. The overlapping-wall protectors 56 are formed in ranges substantially corresponding to the entire second overlapping walls 46, except areas of the lock pieces 50. The overlapping-wall protectors 56 are connected with the bottom ends of the lock-piece protectors 54. Thus, the overlapping-wall protectors 56 and the lock-piece protectors 54 form continuous walls. The projecting distances of the overlapping-wall protectors 56 and the lock-piece protectors 54 from the outer surface of the first cover shell 29 are substantially equal, so that the outer surfaces of the overlapping-wall protectors 56 and the lock-piece protectors 54 are substantially flush with each other. Further, the lock-piece protectors 54 are displaced up (back with respect to the assembling direction) from the overlapping-wall protectors 56 by as much as the lock pieces 50 project from the leading ends of the second overlapping walls 46.

Figure 20:
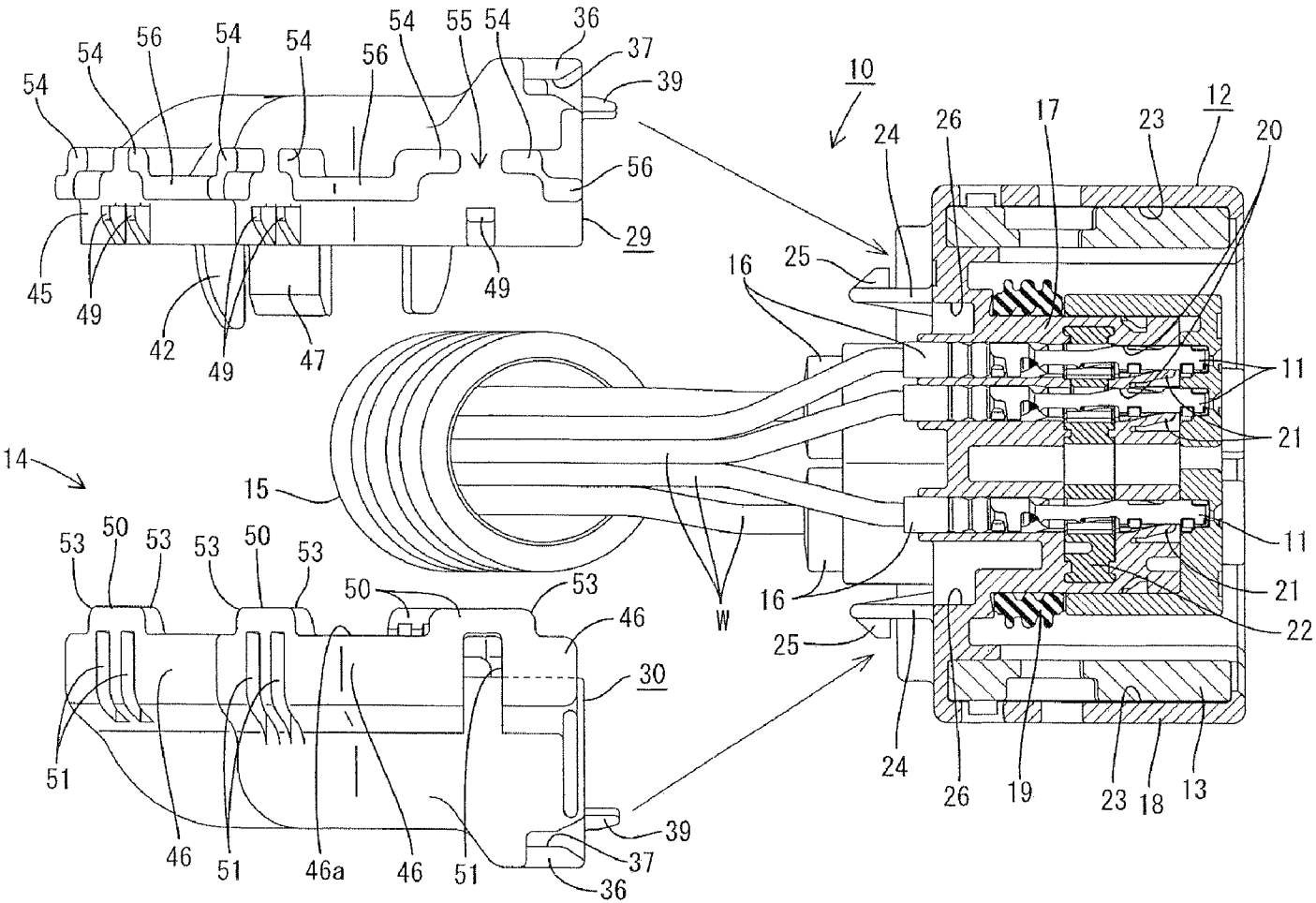
FIG. 20 is a side view in section showing a state before the both cover-divided parts are mounted on the housing.

Upon assembling the connector 10, the terminal fittings 11 connected with the ends of the wires W are inserted and retained in the cavities 20 of the housing 12. Then, as shown in FIG. 20, the cover 14 is mounted on the housing 12 and the corrugated tube 15 while the corrugated tube 15 surround parts of the bundle of the wires W drawn out from the rear the housing 12 is kept at a specified position slightly distanced back from the housing 12.

Figure 21:
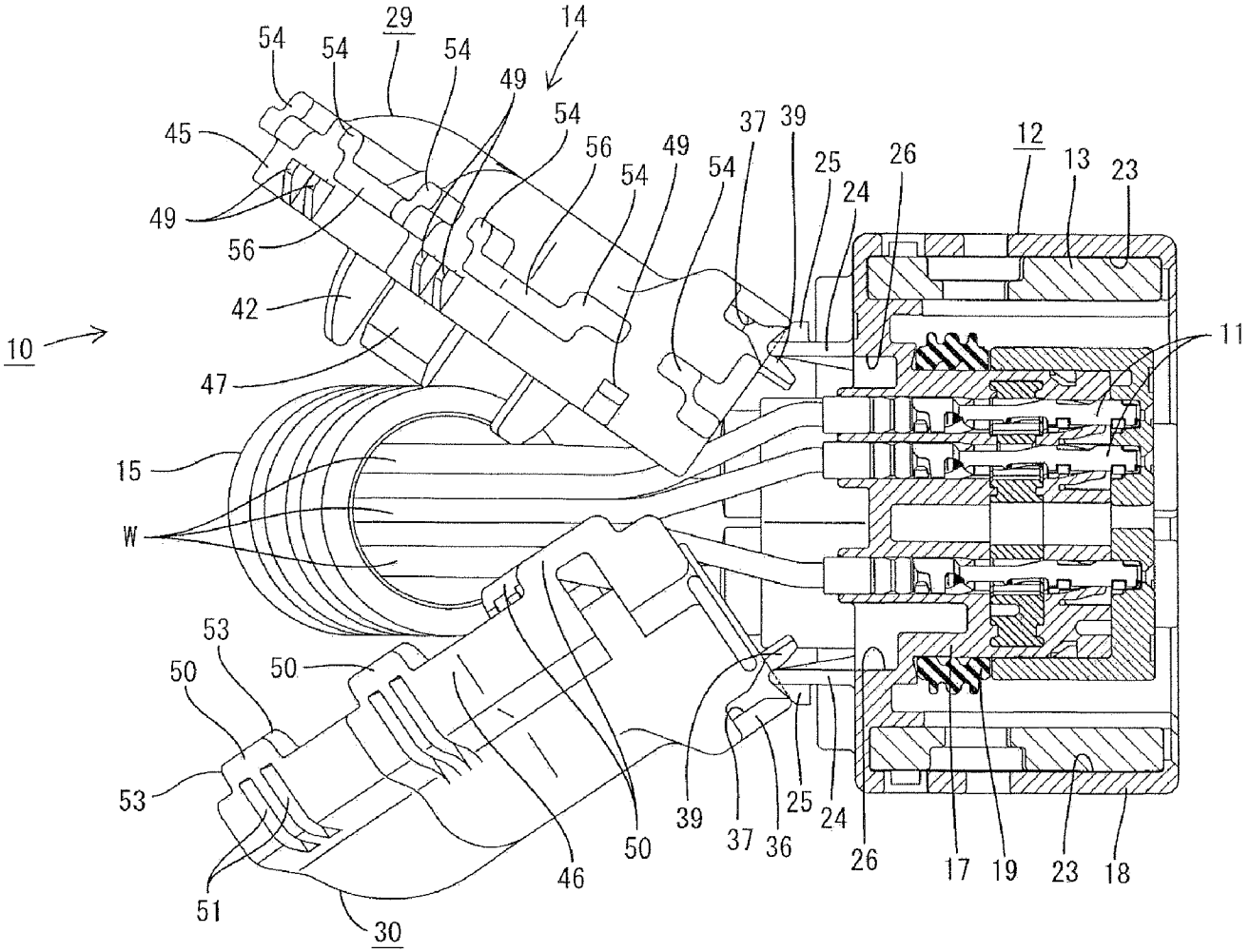
FIG. 21 is a side view in section showing an intermediate state while the both cover-divided parts are being mounted on the housing.

Upon mounting the cover 14, the two cover shells 29, 30 are held in postures so that their inner surfaces are opposed to each other and the spacing between their rear sides is larger than the spacing between the front sides, as shown in FIG. 21. In this state, the two cover shells 29, 30 are closed while the respective water blocking pieces 39 at the front are inserted into the corresponding bores 26 of the housing 12 and the plates 24 are inserted into the corresponding slits 37. In this process, the first overlapping wall 45 is held between the second overlapping walls 46 and the guiding walls 48. Thus, the two cover shells 29, 30 are positioned horizontally and the lock pieces 50 move onto the corresponding locks 49 to be deformed temporarily outward.

Figure 22:
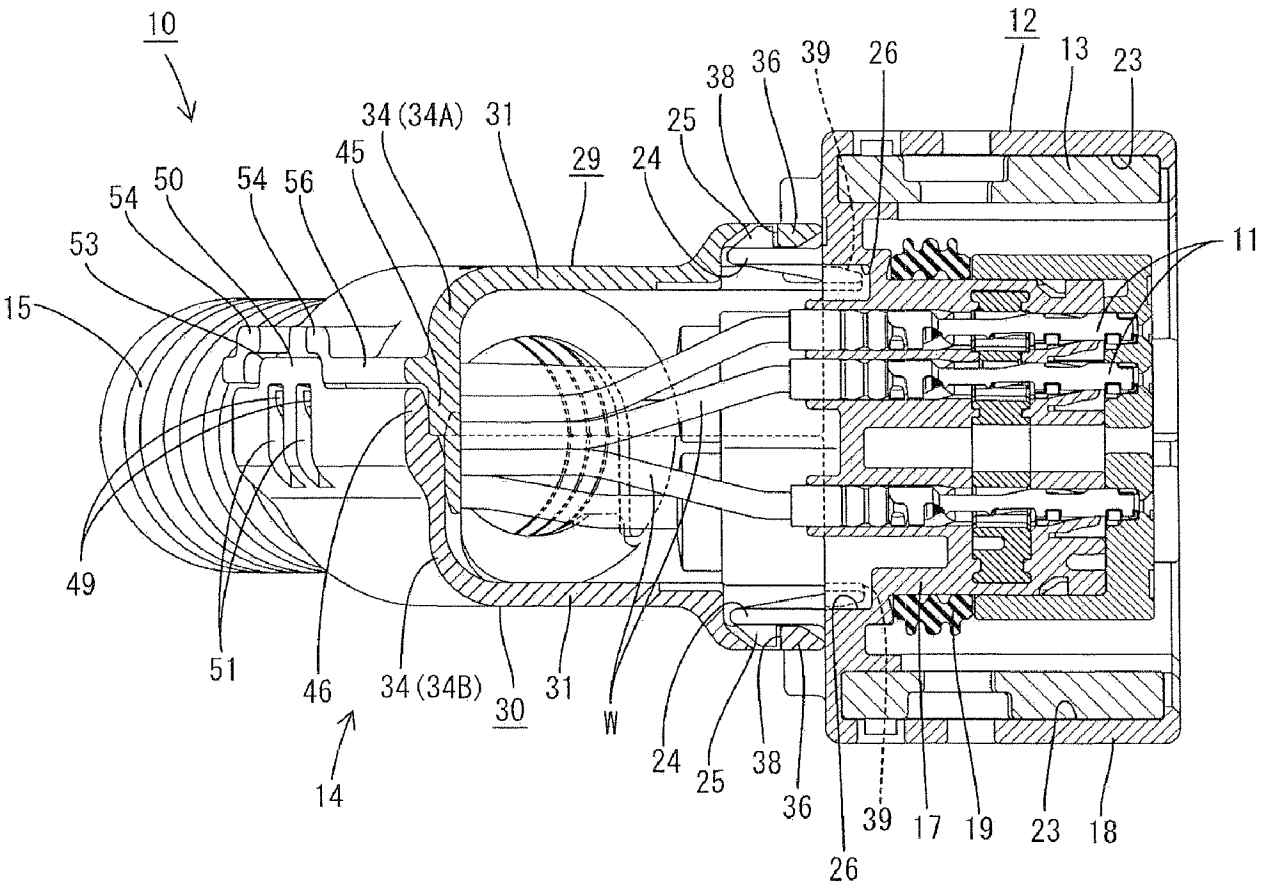
FIG. 22 is a side view in section showing a state where the both cover-divided parts are mounted on the housing.
Figure 23:
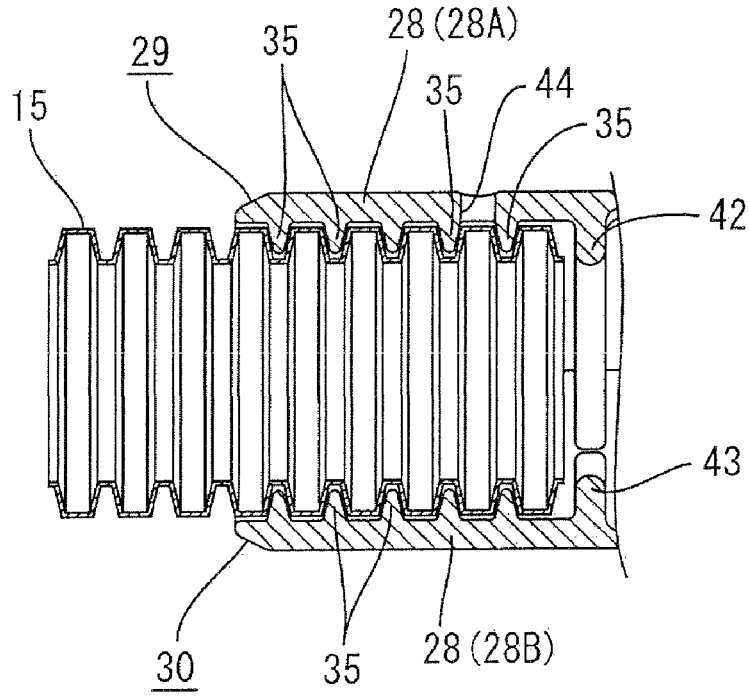
FIG. 23 is a section showing a structure of the tube holding portion for holding a corrugated tube.

When the two cover shells 29, 30 are assembled properly, the housing locking pieces 36 engaged with the corresponding cover locks 25 at the front of the cover 14 and the lock pieces 50 are restored resiliently to fit the locks 49 into the lock grooves 51 and engage them with the upper groove edges, as shown in FIG. 22. In this way, the two cover shells 29, 30 are held properly assembled with each other and held properly mounted on the housing 12. On the other hand, at the rear side of the cover 14, the locking ribs 35 of the tube holder 28 are fit and retained in the respective recesses in the outer circumferential surface of the front end portion of the corrugated tube 15, as shown in FIG. 23. In this way, the corrugated tube 15 is held in its mounted state by the cover 14.

In the above manner, the cover 14 is mounted to the rear end of the housing 12 and the front end portion of the corrugated tube 15, and the wires W drawn out from the rear surface of the housing 12 are covered by the cover 14 and the corrugated tube 15 to have the layout direction thereof determined.

The connector 10 assembled as described above forms an end part of a wiring harness and often is handled roughly during transportation to an automotive assembly line or at the time of assembling. Thus, there is a high possibility that members, such as wires W of another wiring harness and/or external matter, will interfere with the connector 10. If the lock pieces 50 should get caught by the wires W or the like, the lock pieces 50 may be deformed in unlocking directions to be inadvertently disengaged from the locks 49, resulting in a possible separation of the two cover shells 29, 30.

However, in this embodiment, the first cover shell 29 with the locks 49 includes the lock-piece protectors 54 arranged substantially adjacent to the leading end corners 53 of the respective lock pieces 50 and projecting more outward than the lock pieces 50 in thickness directions thereof, as shown in FIGS. 15 to 19. Thus, the wires W or external matter cannot interfere with and catch the leading end corners 53 of the lock pieces 50. The corrugated tube 15 often is pulled from the outside. However, the lock-piece protectors 54 protect the leading end corners 53 of the lock pieces 50 corresponding to the tube holder 28 that holds the corrugated tube 15. Thus, disengagement of the lock pieces 50 is prevented effectively even if an external force acts on the corrugated tube 15. As a result, the inadvertent separation of the two cover shells 29, 30 can be prevented.

The lock-piece protectors 54 are present at least at positions diagonally opposite to the leading end corners 53 of the lock pieces 50. Thus, the interference of the wires W and the like with the leading end corners 53 of the lock pieces 50 is prevented effectively.

The lock-piece protectors 54 are angled or L-shaped to surround at least parts of the leading end corners 53 of the lock pieces 50. Thus, the interference of the wires W and the like with the leading end corners 53 of the lock pieces 50 is prevented reliably, and a highly significant effect of preventing the separation can be obtained.

Two lock-piece protectors 54 are arranged in correspondence with the opposite leading end corners 53 of the each lock piece 50 with the disengagement space 55 used to disengage the lock piece 50 defined therebetween. Thus, the leading end of the lock piece 50 easily can be moved for disengagement by inserting a disengaging jig into the disengagement space 55 between the two lock-piece protectors 54 to detach the cover 14 for maintenance or another reason. Further, interference of the wire W or the like with the opposite leading end corners 53 of each lock piece 50 is prevented.

The first cover shell 29 includes the first overlapping walls 45, the second cover shell 30 includes the second overlapping walls 46 to be placed outside the respective first overlapping walls 45 in the assembled state and the lock pieces 50 extend in the assembling direction from the second overlapping walls 46. The two cover shells 29, 30 are positioned with respect to a direction intersecting the assembling direction by the overlapping walls 45, 46 after assembling. Thus, assembling operability is improved. Further, the lock pieces 50 extend in the assembling direction from the second overlapping walls 46, and the lock pieces 50 can have sufficient springiness.

The first cover shell 29 includes the overlapping-wall protectors 56 facing the leading ends 46*a* of the second overlapping walls 46 of the second cover shell 30 at adjacent positions. Thus, interference of the wire W or the like with the second overlapping walls 46 at the outer side can be prevented and the action of a separating force on the two cover shells 29, 30 can be prevented. In addition, the overlapping-wall protectors 56 project out beyond the second overlapping walls 46 in the thickness directions thereof. Thus, the wires W or the like are less likely to catch the second overlapping walls 46.

The overlapping-wall protectors 56 are connected with the lock-piece protectors 54 to form substantially continuous walls and the lock pieces 50 and the second overlapping walls 46 arranged at the outer side can be protected by such continuous walls at once. Thus, the lock pieces 50 and the second overlapping walls 46 reliably can be prevented from getting caught by the wires W and the like. In addition, the overlapping-wall protectors 56 and the lock-piece protectors 54 have the same projecting distance to make the external appearance better and to contribute to miniaturization.

Two locks 49 are provided at a distance from each other and engage with the corresponding lock piece 50 at once. Thus, even if an external force should inadvertently act on either one of the leading end corners 53 of the lock piece 50 in a disengaging direction, there is a high possibility that either one of the two locks 49 arranged at a distance from each other is kept engaged. As a result, inadvertent unlocking can be effectively prevented.

Each lock piece 50 includes the reinforcement 52 insertable between the adjacent locks 49. Thus, the strength of the lock piece 50 can be increased and the springiness or resiliency of the lock piece 50 can be improved to prevent damage to the lock piece 50.

The lock pieces 50 and the locks 49 are at a plurality of positions near the division end portions of the two cover shells 29, 30 and the lock-piece protectors 54 are provided in correspondence with the respective lock pieces 50. Thus, unintended separation of the two cover shells 29, 30 is made even more difficult.

Clearances between the lock-piece protectors 54 and the lock pieces 50 are substantially equal to or smaller than the outer diameter of the wires W. Thus, the entrance of the wires W into the clearances between the lock-piece protectors 54 and the lock pieces 50 is prevented reliably.

A second embodiment of the invention is described with reference to FIGS. 24 to 27. In this second embodiment, the separation preventing function is strengthened. The similar or same structures, functions and effects as those of the first embodiment described above are not repeatedly described in the second embodiment.

Figure 24:
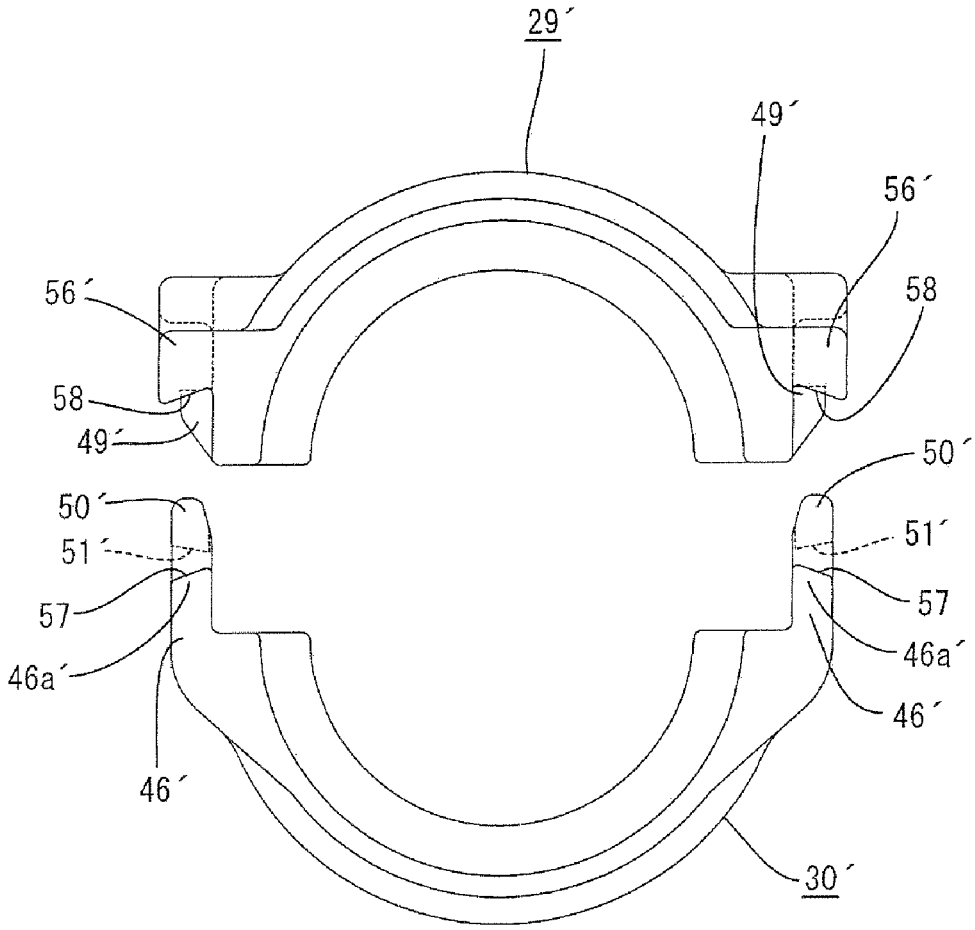
FIG. 24 is an exploded rear view of a connector cover according to a second embodiment of the invention.
Figure 25:
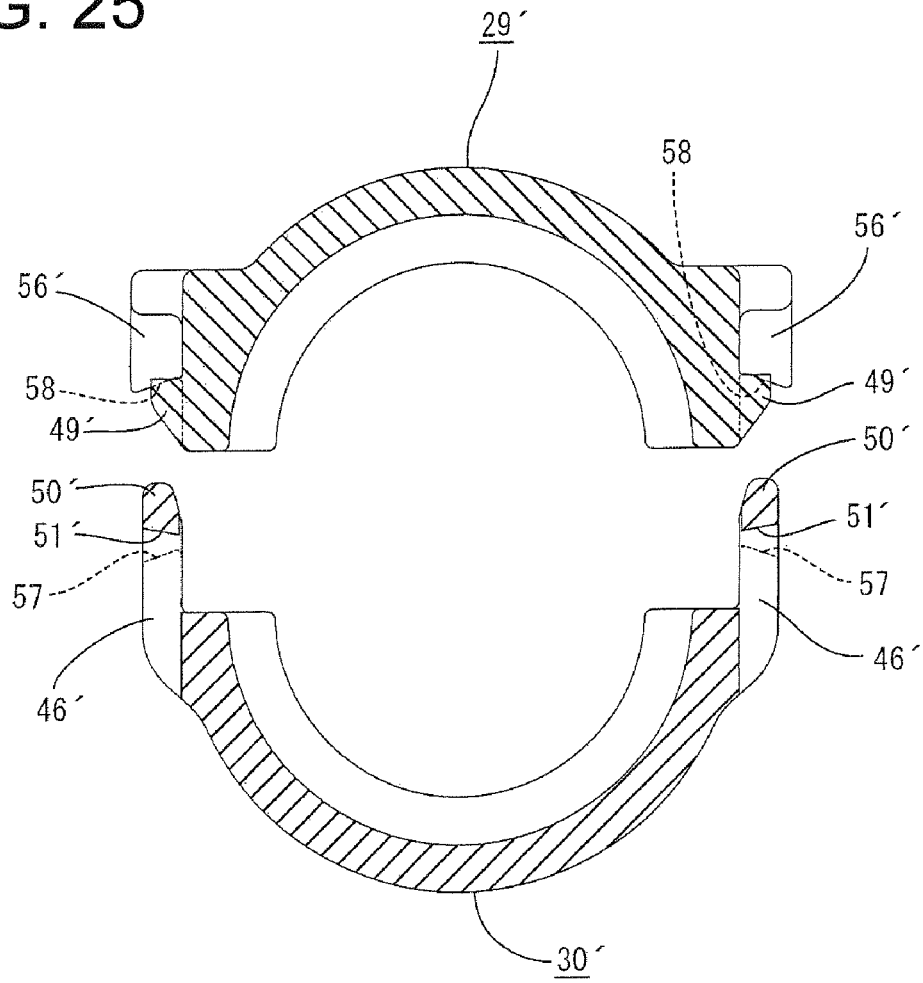
FIG. 25 is an exploded section of the connector cover.

As shown in FIGS. 24 and 25, tapered surfaces 57 are formed on leading ends 46*a*' of second overlapping walls 46' of a second cover shell 30'. The tapered surfaces 57 incline the substantially entire leading end surfaces of the second overlapping walls 46' to face obliquely outward. Reverse tapered surfaces 58 substantially in conformity with the tapered surfaces 57 of the second overlapping walls 46' are formed on the substantially facing surfaces of overlapping-wall protectors 56' substantially facing the second overlapping walls 46'. The reverse tapered surfaces 58 incline the substantially entire facing surfaces to face obliquely inward towards sides opposite to unlocking directions since the entire facing surfaces of the overlapping-wall protectors 56' facing the second overlapping wall 46' are formed into overhanging or undercut surfaces. The reverse tapered surfaces 58 are formed at an angle to be substantially parallel to the tapered surfaces 57 of the second overlapping walls 46'. Therefore, the overlapping-wall protectors 56' have widths gradually increased toward the projecting ends and project more toward the second overlapping walls 46' at the projecting ends.

Figure 26:
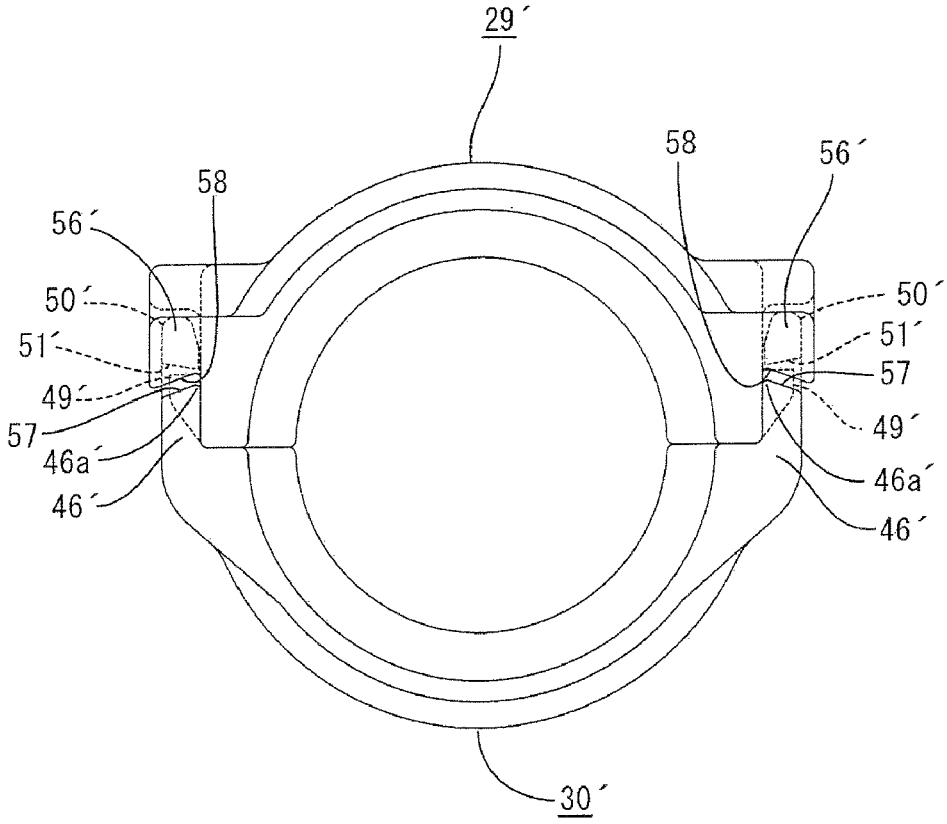
FIG. 26 is a rear view showing a state where the division end surfaces of both cover-divided parts are held in contact.

As shown in FIG. 26, with the division end surfaces of the two cover shells 29', 30' held in contact with each other and with clearances defined between the upper groove edges of lock grooves 51' of lock pieces 50' and the upper end surfaces of locks 49' in the assembled state, the leading ends 46*a*' of the second overlapping walls 46' are located inside the reverse tapered surfaces 58 and the leading ends of the tapered surfaces 57 and those of the reverse tapered surfaces 58 overlap in vertical direction. Thus, even if a force acts to open the lock piece 50' or the second overlapping wall 46' outward in an unlocking direction in the assembled state, the tapered surface 57 interferes with the reverse tapered surface 58 to be guided inwardly, thereby suppressing an outward opening deformation. As a result, the inadvertent disengagement of the lock pieces 50' can be prevented.

Figure 27:
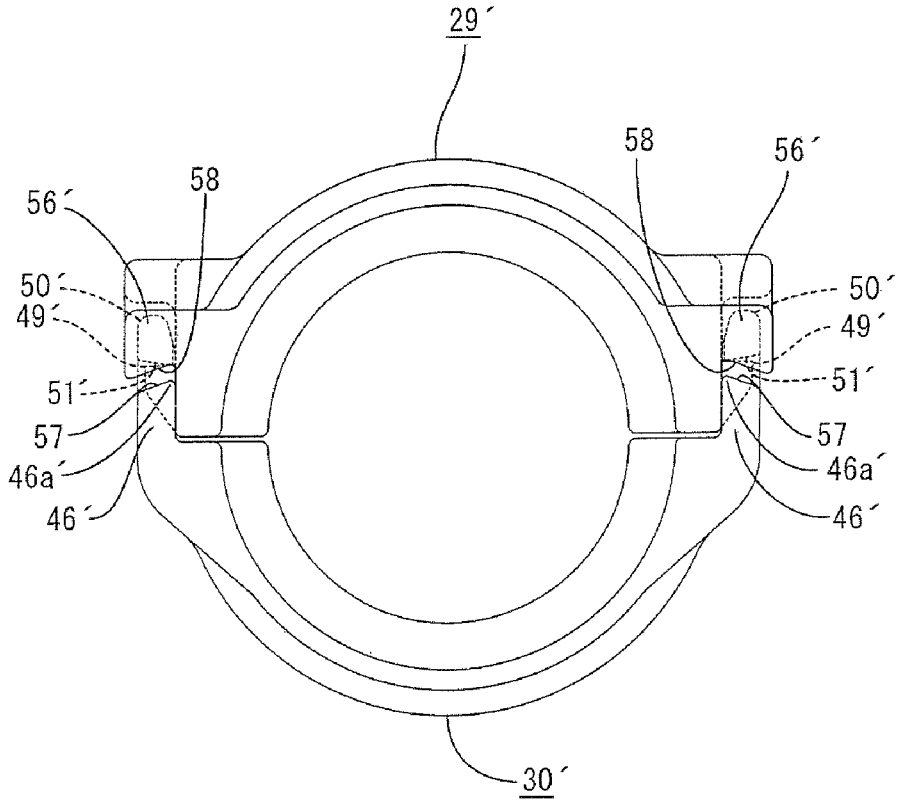
FIG. 27 is a rear view showing a state where lock portions are held in contact with lock pieces.

On the other hand, with a clearance defined between the division end surfaces of the two cover shells 29', 30' and with the upper groove edges of the lock grooves 51' of the lock pieces 50' and the upper end surfaces of the locks 49' held in contact in the assembled state as shown in FIG. 27, the leading ends of the tapered surfaces 57 and those of the reverse tapered surfaces 58 are distanced vertically. Thus, in the above assembled state, the lock pieces 50' can be deformed outwardly and disengaged for maintenance or another reason.

As described above, according to this embodiment, the overlapping-wall protectors 56' are formed with the reverse tapered surfaces 58 at least partly covering the leading ends 46*a*' of the second overlapping walls 46' of the second cover-divided part 30' from the outer side. Thus, the second overlapping walls 46' connected with the lock pieces 50' are prevented from being deformed outwardly, with the result that the inadvertent disengagement of the lock pieces 50' can be prevented more reliably.

The reverse tapered surfaces 58 are formed in the entire areas of the overlapping-wall protecting portions 56' and two of the reverse tapered surfaces 58 are arranged at the opposite sides of each lock piece 50'. Thus, the inadvertent disengagements of the lock pieces 50' is prevented more reliably.

The invention is not limited to the above described and illustrated embodiment. For example, the following embodiments are also embraced by the technical scope of the present invention as defined by the claims.

The lock-piece protectors are L-shaped in the above-described embodiments. However, they may be, for example, substantially straight along leading end surfaces or lateral end surfaces of the lock pieces. In such a case, the lock-piece protectors can be at positions diagonally opposite to the leading end corners of the lock pieces by forming the lock-piece protectors extending along the leading end surfaces of the lock pieces to project out beyond the lateral end surfaces of the lock pieces or forming the lock-piece protectors extending along the lateral end surfaces of the lock pieces to project out beyond the leading end surfaces of the lock pieces.

Each pair of left and right lock-piece protectors corresponding to one lock piece may be connected to eliminate the disengagement space.

The overlapping-wall protectors cover substantially the entire leading ends of the second overlapping walls in the above-described embodiment. However, they may be arranged to cover part of the second overlapping walls. Further, the overlapping-wall protectors may be separated from the lock-piece protectors, and/or the height of the overlapping-wall protectors may differ from that of the lock-piece protectors. Furthermore, the overlapping-wall protectors may be omitted according to the invention.

Although the cover shells include the overlapping walls in the above-described embodiments, the overlapping walls may be omitted.

Although the reverse tapered surfaces preferably are formed in the substantially entire overlapping-wall protectors in the second embodiment, they may be formed in parts of the overlapping-wall protectors according to the invention. In such a case, a pair of reverse tapered surfaces may be arranged at the substantially opposite sides or only at one side of each lock piece. Further, the tapered surfaces of the second overlapping walls may be partly or entirely omitted.

Although the wider lock pieces and the narrower lock piece are provided and each wider lock piece is engaged with two locks in the above embodiments, one wider lock may be engaged with each wider lock piece. Connector covers including only narrower lock pieces and connector covers including only wider lock pieces each engageable with two locks also are embraced by the present invention. Further, three or more lock pieces may be engaged with each wider lock. Furthermore, the reinforcing portion may be omitted from the wider lock according to the present invention.

The arrangement positions and/or the number of the lock pieces can be changed according to needs.

The connector cover is divided horizontally in the above described embodiments. However, it may be divided vertically. Further, the dividing positions may be changed besides the one to halve the connector cover.

Although the two or more cover shells are separated in the above respective embodiments, they may be partly connected via at least one hinge to be united into one part according to the present invention.

The first cover shell includes the locks and the second cover shell includes the lock pieces in the above embodiments. However, the reversed arrangement may be adopted. Alternatively, each cover shell may include both the locks and the lock pieces. In such a case, both cover shells may be identical, and the same parts can be used for both.

An angle of the tube holder to the cover main body (wire draw-out angle) can be changed. For example, the tube holder may extend immediately lateral to, behind, above or below the connector cover.

The connector has the slide lever in the illustrated embodiments. However, the connector may have no slide lever and/or a different type of movable member such as a rotatable or pivotable lever.

The corrugated tube to be connected with the connector may be made of metal, composite material, rubber besides instead of synthetic resin.

What is claimed is:

1. A connector cover adapted to hold at least one wire protecting tube at least partly surrounding one or more wires drawn out from a housing and mountable on the housing, comprising; at least first and second cover shells to be assembled with each other, the cover shells including tube holders for holding a portion of the wire protecting tube therebetween, the first cover shell including at least one lock, the second cover shell including at least one lock piece engageable with the respective lock to hold the cover shells in an assembled state, and the first cover shell including at least one lock-piece protecting portion adjacent to at least one leading end corner of the lock piece corresponding to the tube holder and projecting out beyond the lock piece in a thickness direction thereof.

2. The connector cover of claim 1, wherein the lock-piece protecting portion is substantially diagonally opposite to the leading end corner of the lock piece.

3. The connector cover of claim 1, wherein the lock-piece protecting portion substantially is curved or L-shaped to at least partly surround the leading end corner of the lock piece.

4. The connector cover of claim 1, wherein at least one pair of lock-piece protecting portions are arranged substantially in correspondence with the substantially opposite leading end corners of the lock piece and being spaced apart from each other to define an disengagement space for disengaging the lock piece.

5. The connector cover of claim 1, wherein overlapping walls are provided at or near division end portions of the cover shells to be placed one inside the other in the assembled state, the overlapping wall of the second cover shell being arranged outside that of the first cover shell, and the lock pieces extend substantially in an assembling direction from the overlapping wall of the second cover shell.

6. The connector cover of claim 5, wherein the first cover shell includes at least one overlapping-wall protecting portion that substantially faces the leading end of the overlapping wall of the second cover shell at an adjacent position.

7. The connector cover of claim 6, wherein the overlapping-wall protecting portion projects more outward than the overlapping wall of the second cover shell in the thickness directions thereof.

8. The connector cover of claim 7, wherein the lock-piece protecting portion is connected with the overlapping-wall protecting portion.

9. The connector cover of claim 6, wherein the overlapping-wall protecting portion and the lock-piece protecting portion have equal projecting distances.

10. The connector cover of claim 6, wherein the overlapping-wall protecting portion is formed with at least one reverse tapered surface for at least partly covering the leading end of the overlapping wall of the second cover shell from an outer side.

11. The connector cover of claim 10, wherein two reverse tapered surfaces are formed at positions of the overlapping-wall protecting portion at substantially opposite sides of the lock piece.

12. The connector cover of claim 1, wherein the locks are provided at positions spaced apart from each other and engageable with the corresponding lock piece substantially at once, wherein the lock piece includes at least one reinforcement insertable between adjacent locks.

13. The connector cover of claim 1, wherein the lock pieces and the locks are arranged at a plurality of dispersed positions at or near the division end portions of the both cover shells, and the lock-piece protecting portion is provided substantially in correspondence with each lock piece.

14. The connector cover of claim 1, wherein a clearance between the lock-piece protecting portion and the lock piece is no greater than the outer diameter of the wires.

* * * * *